US009773408B2

(12) United States Patent
Kim et al.

(10) Patent No.: US 9,773,408 B2
(45) Date of Patent: Sep. 26, 2017

(54) MOBILE TERMINAL AND OPERATION METHOD THEREOF

(71) Applicant: LG Electronics Inc., Seoul (KR)

(72) Inventors: Yanghwan Kim, Changwon-si (KR); Hyungsoo Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 64 days.

(21) Appl. No.: 14/149,337

(22) Filed: Jan. 7, 2014

(65) Prior Publication Data

US 2014/0191855 A1 Jul. 10, 2014

(30) Foreign Application Priority Data

Jan. 7, 2013 (KR) ..... 10-2013-0001844

(51) Int. Cl.
*G08C 19/16* (2006.01)
*G08C 17/02* (2006.01)

(52) U.S. Cl.
CPC ..... *G08C 17/02* (2013.01); *G08C 2201/20* (2013.01); *G08C 2201/93* (2013.01)

(58) Field of Classification Search
CPC .... G08C 19/00; G08C 17/02; G08C 2201/31; B60R 16/027; G06Q 10/06; G06Q 10/087; G05B 19/4183; G05B 19/41865; H01L 21/67276
USPC ..... 709/223, 225, 226, 224, 249, 203; 340/12.54, 236.02, 531, 635; 715/733, 715/734, 736; 704/273; 700/115, 116, 700/117
See application file for complete search history.

(56) References Cited

U.S. PATENT DOCUMENTS

2005/0131991 A1* 6/2005 Ogawa ..... H04L 12/2803 709/201
2008/0238653 A1* 10/2008 Unger ..... 340/531
2009/0019152 A1* 1/2009 Huang ..... H04L 67/125 709/224
2013/0223279 A1* 8/2013 Tinnakornsrisuphap et al. ..... 370/254
2014/0227975 A1* 8/2014 Kuroyama et al. ..... 455/41.1

FOREIGN PATENT DOCUMENTS

CN 1627721 A 6/2005
JP 2005198252 A * 7/2005

* cited by examiner

*Primary Examiner* — Mark Rushing
*Assistant Examiner* — Anthony D Afrifa-Kyei
(74) *Attorney, Agent, or Firm* — Dentons US LLP

(57) ABSTRACT

An operation method of a mobile terminal includes determining a home appliance not registered with a server, displaying an object indicating the retrieved unregistered home appliance on a screen, and, upon receiving an input to register the unregistered home appliance, transmitting product information of the unregistered home appliance to the server. Consequently, product registration for the home appliance is easily and conveniently performed.

18 Claims, 36 Drawing Sheets

MOBILE TERMINAL AND OPERATION METHOD THEREOF

CROSS-REFERENCE TO RELATED APPLICATION

This application claims the priority benefit of Korean Patent Application No. 10-2013-0001844, filed on Jan. 7, 2013, in the Korean Intellectual Property Office, the disclosure of which is incorporated herein by reference.

BACKGROUND

1. Field of the Disclosure

The present disclosure relates to a mobile terminal and an operation method thereof and, more particularly, to a mobile terminal that is capable of easily and conveniently performing product registration for a home appliance and an operation method thereof.

2. Description of the Related Art

A refrigerator, which is a home appliance disposed in a house, stores food for users, a laundry treatment machine, which is another home appliance, treats laundry, an air conditioner, which is another home appliance, adjusts room temperature, and a cooking device, which is yet another home appliance, cooks food.

With the development of various communication modes, research has been conducted into various methods of improving user convenience through communication with the home appliance.

SUMMARY

It is an object to provide a mobile terminal that is capable of easily and conveniently performing product registration for a home appliance and an operation method thereof.

In accordance with one aspect, the above and other objects can be accomplished by the provision of an operation method of a mobile terminal including determining a home appliance not registered with a server, displaying an object indicating the retrieved unregistered home appliance on a screen, and, upon receiving an input to register the unregistered home appliance, transmitting product information of the unregistered home appliance to the server.

In accordance with another aspect, there is provided a mobile terminal including a communication unit to exchange data with home appliances, a display unit to display an object indicating a home appliance not registered with a server among the home appliances on a screen, and a controller to, upon receiving an input to register the unregistered home appliance, control product information of the unregistered home appliance to be transmitted to the server.

BRIEF DESCRIPTION OF THE DRAWINGS

The above and other objects, features and other advantages will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

The terms "module" and "unit," when attached to the names of components, are used herein to aid in understanding of the components and thus, should not be considered as having specific meanings or roles. Accordingly, the terms "module" and "unit" may be used interchangeably.

Figure 1:
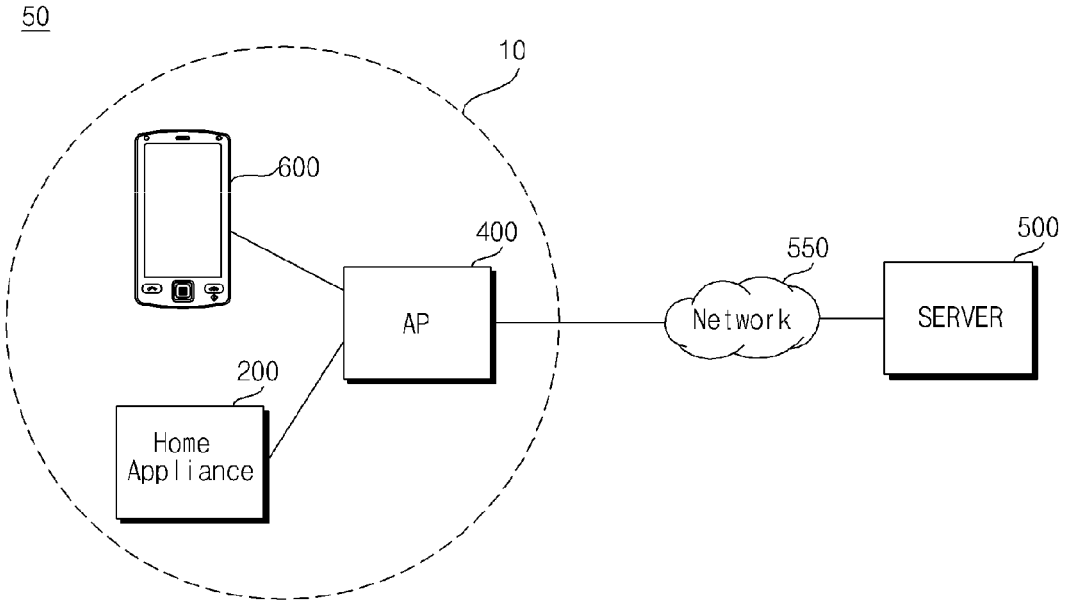
FIG. 1 is a view showing an example of a configuration of a communication system according to an embodiment of the present invention.

FIG. 1 is a view showing an example of a configuration of a communication system according to an embodiment of the present invention.

Referring to FIG. 1, a communication system 50 according to an embodiment of the present invention may include a home appliance 200, an access point (AP) device 400, a server 500, a network 550, and a mobile terminal 600.

The home appliance 200 may be an electric device for home use. For example, the home appliance 200 may be a refrigerator 200*a* (see FIG. 2A), a washing machine 200*b* (see FIG. 2B), an air conditioner 200*c* (see FIG. 2C), a cooking device 200*d* (see FIG. 2D), or a cleaner (see FIG. 2E).

The home appliance 200 may include a communication unit (not shown) provided therein such that the home appliance 200 exchange data with electric devices in an internal network 10 or electric devices accessible via an external network 550 through the communication unit (not shown). To this end, the communication unit (not shown) may exchange data with the AP device 400 in a wired or wireless fashion.

The AP device 400 may provide the internal network 10 to an electric device adjacent thereto. Specifically, the AP device 400 may provide a wireless network.

Meanwhile, the AP device 400 may assign a wireless channel based on a predetermined communication mode to the electric devices in the internal network 10 and perform wireless data communication through the assigned channel. The predetermined communication mode may be a Wi-Fi communication mode.

In this case, the mobile terminal 600 located in the internal network 10 may access the home appliance 200 via the AP device 400 to monitor or remotely control the home appliance 200.

On the other hand, the AP device 400 may perform data communication with an external electric device via the external network 550 in addition to the internal network 10.

For example, the AP device 400 may perform data communication with a mobile terminal 600 located outside the internal network 10 via the external network 550.

At this time, the mobile terminal 600 located in the external network 550 may access the home appliance 200 via the external network 550 and the AP device 400 to monitor or remotely control the home appliance 200.

In another example, the AP device 400 may perform wireless data communication with the server 500, which is located outside the internal network 10, via the external network 550.

The server 500 may be provided with a voice recognition algorithm. In addition, upon receiving voice data, the server 500 may convert the received voice data into text format data and output the converted data.

Meanwhile, the server 500 may store firmware information regarding the home appliance 200 and operation information (course information, etc.) and register product information regarding the home appliance 200. For example, the server 500 may be a server managed by a manufacturer of the home appliance 200. In another example, the server 500 may be a server managed by an open application store administrator.

Meanwhile, the mobile terminal 600 according to the embodiment of the present invention retrieves a home appliance not registered with the server and displays an object indicating the retrieved unregistered home appliance. Upon receiving an input to register the unregistered home appliance, the mobile terminal 600 transmits production information of the unregistered home appliance to the server. Consequently, it is possible to easily and conveniently perform product registration for the unregistered home appliance.

In particular, the mobile terminal 600 may display objects indicating home appliances having access to the same AP device 400 and transmit production information of an unregistered one of the home appliances to the server. Consequently, it is possible to easily and conveniently perform product registration for the unregistered home appliance.

Figure 2A:
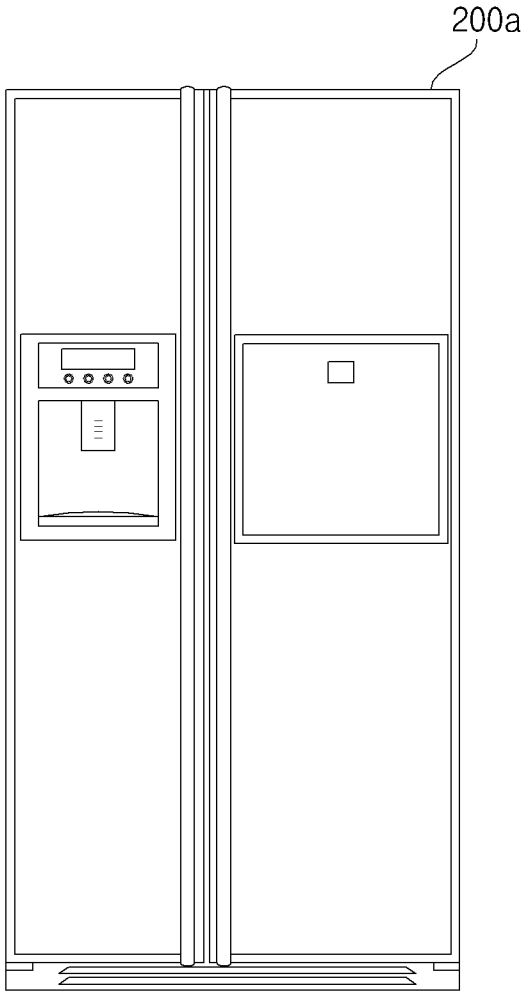
FIGS. 2A to 2E are views illustrating various examples of home appliances.
Figure 2B:
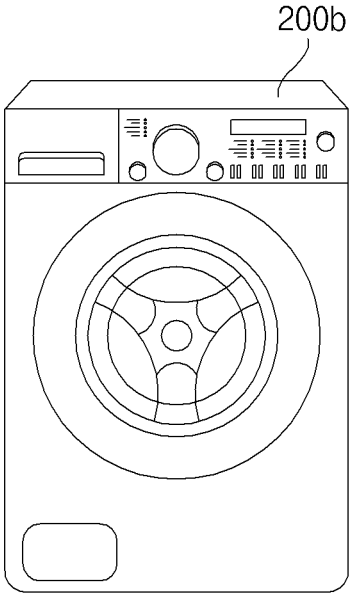
Figure 2C:
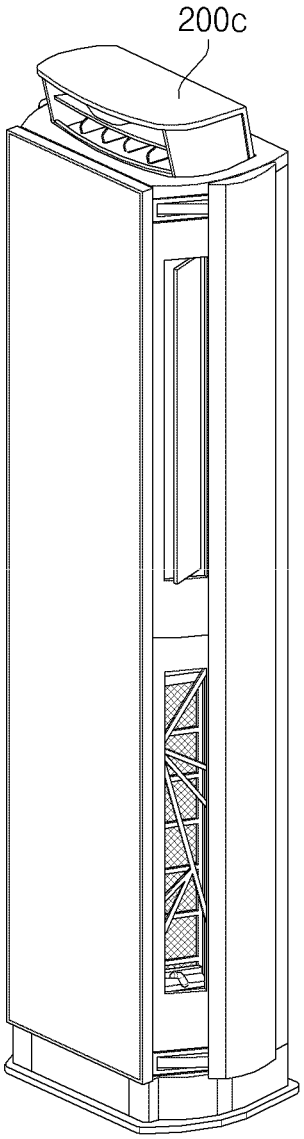
Figure 2D:
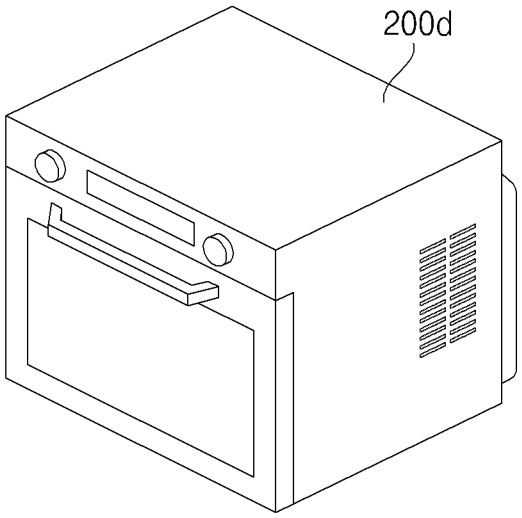
Figure 2E:
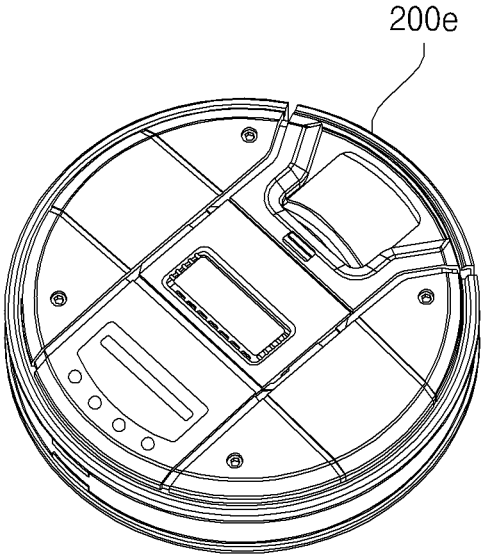

FIG. 2A illustrates a refrigerator 200*a*, FIG. 2B illustrates a washing machine 200*b*, FIG. 2C illustrates an air conditioner 200*c*, FIG. 2D illustrates a cooking device 200*d*, and FIG. 2E illustrates a robot cleaner 200*e*.

Figure 3:
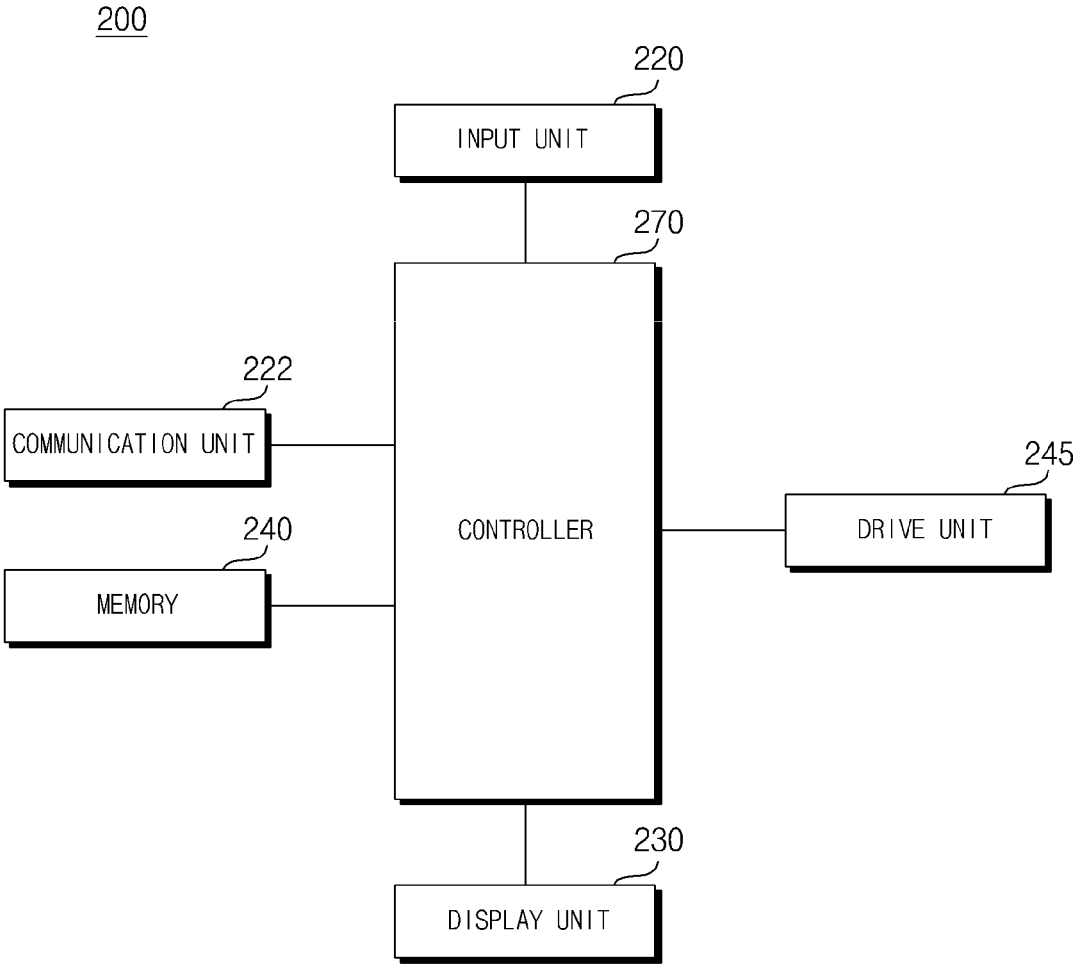
FIG. 3 is an internal block diagram schematically showing a home appliance of FIG. 1.

FIG. 3 is an internal block diagram schematically showing the home appliance of FIG. 1.

Referring to FIG. 3, the home appliance 200 may include an input unit 220 to allow a user input, a display unit 230 to display an operation state of the home appliance, a communication unit 222 to communicate with an external device, a drive unit 245 to drive the home appliance, and a controller 270 to perform internal control.

For example, in a case in which the home appliance is a refrigerator, the drive unit 245 may include a refrigerating compartment drive unit to drive a refrigerating compartment fan configured to supply cooled air into a refrigerating compartment, a freezing compartment drive unit to drive a freezing compartment fan configured to supply cooled air into a freezing compartment, and a compressor drive unit to drive a compressor configured to compress a refrigerant.

In another example, in a case in which the home appliance is a washing machine, the drive unit 245 may include a drive unit to drive a drum or a tub.

In another example, in a case in which the home appliance is an air conditioner, the drive unit 245 may include a compressor drive unit to drive a compressor mounted in an outdoor unit, an outdoor unit fan drive unit to drive an outdoor unit fan configured to perform heat exchange, and an indoor unit fan drive unit to drive an indoor unit fan configured to perform heat exchange.

In another example, in a case in which the home appliance is a cooking device, the drive unit 245 may include a microwave drive unit to output microwaves into a cavity.

In a further example, in a case in which the home appliance is a cleaner, the drive unit 245 may include a fan motor drive unit to drive a fan motor configured to suction air.

Meanwhile, the communication unit 222 may include a near field communication module (not shown) to perform at least near field communication.

In addition, the home appliance 200 may further include a memory 240 to store data.

Figure 4:
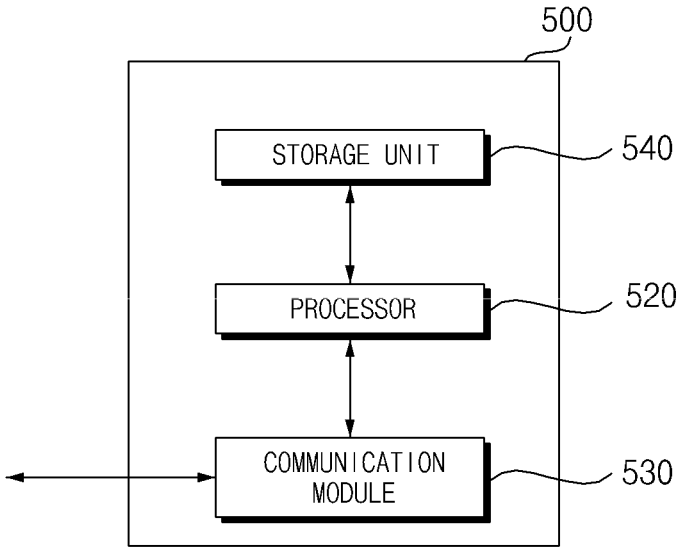
FIG. 4 is an internal block diagram showing a server of FIG. 1.

FIG. 4 is an internal block diagram showing the server of FIG. 1.

Referring to FIG. 4, the server 500 may include a communication module 530, a storage unit 540, and a processor 520.

The communication module 530 may receive information related to a home appliance from the mobile terminal 600. Specifically, the communication module 530 may receive product information of the home appliance from the mobile terminal 600. In addition, the communication module 530 may transmit product information registration result information regarding the received product information of the home appliance to the mobile terminal 600.

To this end, the communication module 530 may include an Internet module or a mobile communication module.

The storage unit 540 may store the received product information of the home appliance. In addition, the storage unit 540 may store the received product information of the home appliance to perform product registration for the home appliance.

The processor 520 may control overall operation of the server 500.

Meanwhile, upon receiving the product information of the home appliance from the mobile terminal 600, the processor 520 may control product registration result information of the home appliance to be generated. In addition, the processor 520 may control the generated product registration result information to be transmitted to the mobile terminal 600.

In another example, in a case in which the information related to the home appliance is power consumption information of the home appliance, the processor 520 may control power information, such as power price information, on peak time power information, off peak time power information, and real time power information, stored in the storage unit 540 to be transmitted to the mobile terminal 600.

Meanwhile, the server 500 may be a server managed by a manufacturer of the home appliance 200 or a server managed by an administrator of a store for applications related to the home appliance 200.

Figure 5:
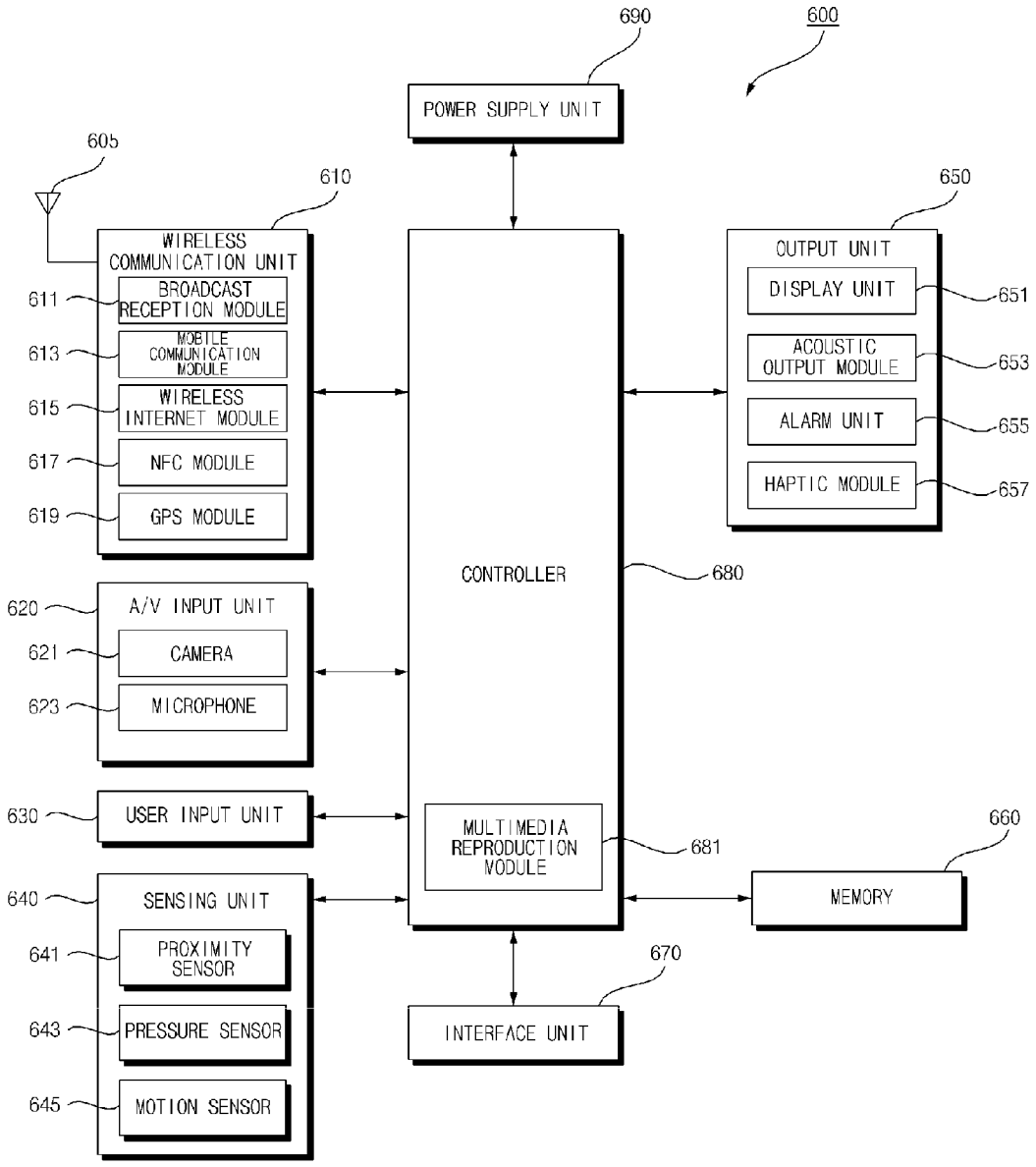
FIG. 5 is an internal block diagram showing a mobile terminal of FIG. 1.

FIG. 5 is an internal block diagram showing the mobile terminal of FIG. 1.

Referring to FIG. 5, the mobile terminal 600 may include a wireless communication unit 610, an audio/video (A/V) input unit 620, a user input unit 630, a sensing unit 640, an output unit 650, a memory 660, an interface unit 670, a controller 680, and a power supply unit 690.

The wireless communication unit 610 according to the embodiment of the present invention may exchange data with the server 500 via the network 550 in a wireless fashion. For example, in a case in which the mobile terminal 600 is in a power monitoring mode for an internal power network, the wireless communication unit 610 may transmit a request for power monitoring and receive monitoring information in response thereto. In another example, in a case in which the mobile terminal 600 is in a remote control mode for the internal power network, the wireless communication unit 610 may transmit a remote control signal and receive result information regarding remote control.

The wireless communication unit 610 may include a broadcast reception module 611, a mobile communication module 613, a wireless Internet module 615, a near field communication (NFC) module 617, and a global positioning system (GPS) module 619.

The broadcast reception module 611 may receive a broadcast signal and/or broadcast-related information from an external broadcast management server through a broadcast channel. The broadcast channel may include a satellite channel and a terrestrial channel.

The broadcast signal and/or the broadcast-related information received through the broadcast reception module 611 may be stored in the memory 660.

The mobile communication module 613 transmits and receives a wireless signal to and from at least one selected from among a base station, an external terminal, and a server via a mobile communication network. The wireless signal may include a voice call signal, a video communication call signal, and various types of data based on text/multimedia message transmission and reception.

The wireless Internet module 615 is a module for wireless Internet access. The wireless Internet module 615 may be mounted inside or outside the mobile terminal 600. For example, the wireless Internet module 615 may perform wireless communication based on Wi-Fi or wireless communication based on Wi-Fi Direct.

The NFC module 617 may perform near field communication. In a case in which the NFC module 617 is within a predetermined distance from an electric device equipped with an NFC tag or an NFC module, i.e., the NFC module 617 can perform tagging, the NFC module 617 may receive or transmit data from or to the electric device.

In addition, Bluetooth, radio frequency identification (RFID), infrared data association (IrDA), ultra wideband (UWB), or ZigBee may be used as short range communication technology.

The GPS module 619 may receive position information from a plurality of GPS satellites.

The A/V input unit 620 is provided to allow an audio signal or video signal input. The A/V input unit 620 may include a camera 621 and a microphone 623.

The user input unit 630 generates key input data input by a user to control the operation of the terminal. To this end, the user input unit 630 may include a keypad, a dome switch, and a touch pad (static pressure or electrostatic). Particularly, in a case in which the touch pad forms a layered structure together with a display unit 651, an assembly of the touch pad and the display unit 651 may be called a touchscreen.

The sensing unit 640 may sense a current state of the mobile terminal 600, such as an open or closed state of the mobile terminal 600, the position of the mobile terminal 600, and whether user contact with the mobile terminal 600 has been performed, to generate a sensing signal to control the operation of the mobile terminal 600.

The sensing unit 640 may include a proximity sensor 641, a pressure sensor 643, and a motion sensor 645. The motion sensor 645 may sense the motion or position of the mobile terminal 600 using an acceleration sensor, a gyro sensor, a gravity sensor, etc. In particular, the gyro sensor is a sensor to measure angular velocity of the mobile terminal 600. The gyro sensor may sense a direction (angle) of the mobile terminal 600 rotated from a reference direction.

The output unit 650 may include a display unit 651, an acoustic output module 653, an alarm unit 655, and a haptic module 657.

The display unit 651 outputs, i.e., displays, information processed by the mobile terminal 600.

Meanwhile, in a case in which the display unit 651 and the touch pad are disposed as a layered structure to form a touchscreen as previously described, the display unit 651 may also be used as an input device that allows a user to input information by touch in addition to an output device.

The acoustic output module 653 outputs audio data received from the wireless communication unit 610 or stored in the memory 660. The acoustic output module 653 may include a speaker and a buzzer.

The alarm unit 655 outputs a signal to inform about generation of an event of the mobile terminal 600. For example, the alarm unit 655 may output a signal in the form of vibration.

The haptic module 657 generates a variety of tactile effects that a user may feel. A typical example of the tactile effects generated by the haptic module 657 is a vibration effect.

The memory 660 may store a program for processing or control of the controller 680 or temporarily store input or output data (for example, phonebooks, messages, still images, moving images, etc.).

The interface unit 670 interfaces between the mobile terminal 600 and all external devices connected to the mobile terminal 600. The interface unit 670 may receive data or power from the external devices and transmit the received data or power to the respective components of the mobile terminal 600. In addition, data may be transmitted from the mobile terminal 600 to the external devices via the interface unit 670.

The controller 680 controls operations of the respective components of the mobile terminal 600, thereby controlling overall operation of the mobile terminal 600. For example, the controller 680 may perform control or processing for voice communication, data communication, and video communication. In addition, the controller 680 may further include a multimedia reproduction module 681 to reproduce multimedia. The multimedia reproduction module 681 may be incorporated into the controller 680 in the form of hardware. Alternatively, the multimedia reproduction module 681 may be configured in the form of software separate from the controller 680.

The power supply unit 690 supplies external power or internal power to the respective components of the mobile terminal 600 under control of the controller 680.

The block diagram of FIG. 5 shows components constituting the mobile terminal 600 according to the embodiment of the present invention. The respective components in the block diagram may be integrated, added, or omitted according to the specifications of an actually implemented mobile terminal 600. That is, two or more components may be combined into a single unit as needed. Alternatively, one component may be divided into two or more components as needed. In addition, functions performed by the respective blocks are illustrated to describe the embodiment of the present invention and, therefore, concrete operations or devices of the respective blocks do not restrict the scope of rights claimed by the present invention.

Figure 6:
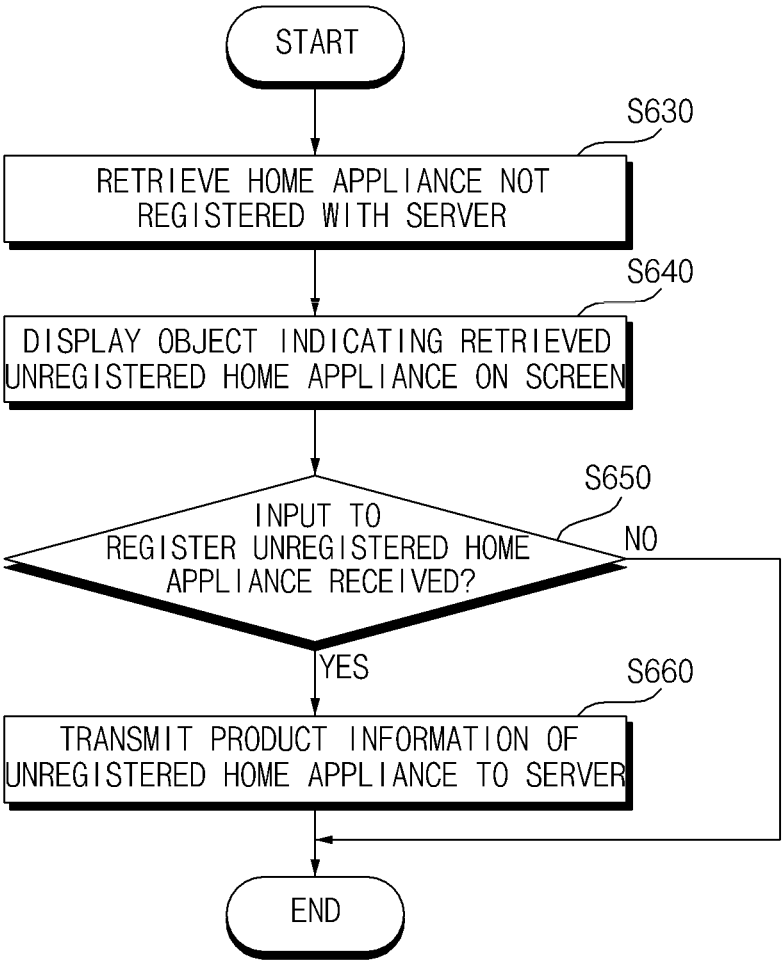
FIG. 6 is a flowchart showing an example of an operation method of the mobile terminal of FIG. 1.

FIG. 6 is a flowchart showing an example of an operation method of the mobile terminal of FIG. 1 and FIGS. 7 to 11J are reference views illustrating the operation method of FIG. 6.

First, the mobile terminal 600 may execute an application related to a home appliance (S705).

Upon receiving a user input to execute an application related to a home appliance, the controller 680 of the mobile terminal 600 may control an application related to a home appliance pre-installed in the mobile terminal 600 to be driven.

Figure 9A:
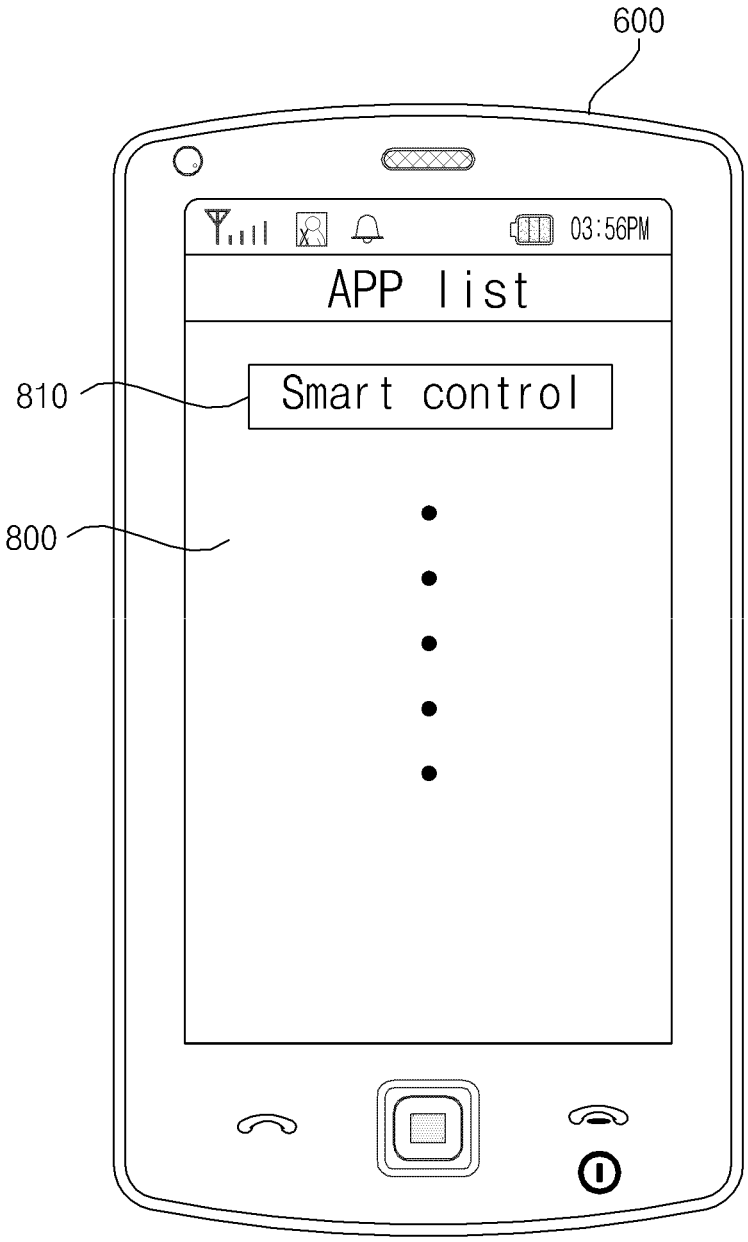

FIG. 9A illustrates that an application list screen 800 related to home appliances is displayed on the mobile terminal 600.

Figure 9B:
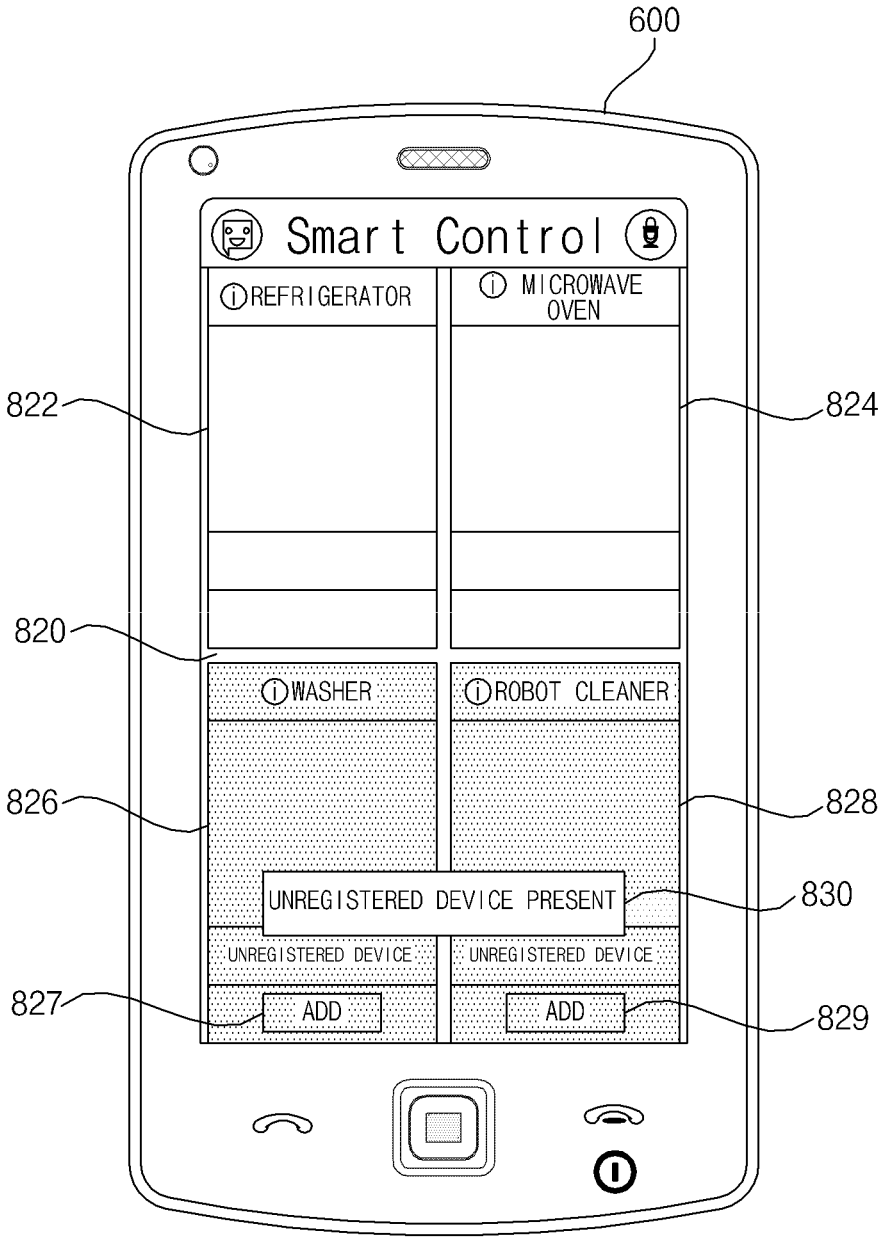

When a user selects a smart control item 810, a home appliance integration application to control the home appliances may be executed. FIG. 9B illustrates that objects 822, 824, 826, and 828 indicating a plurality of home appliances are simultaneously displayed on the same screen.

Figure 7:
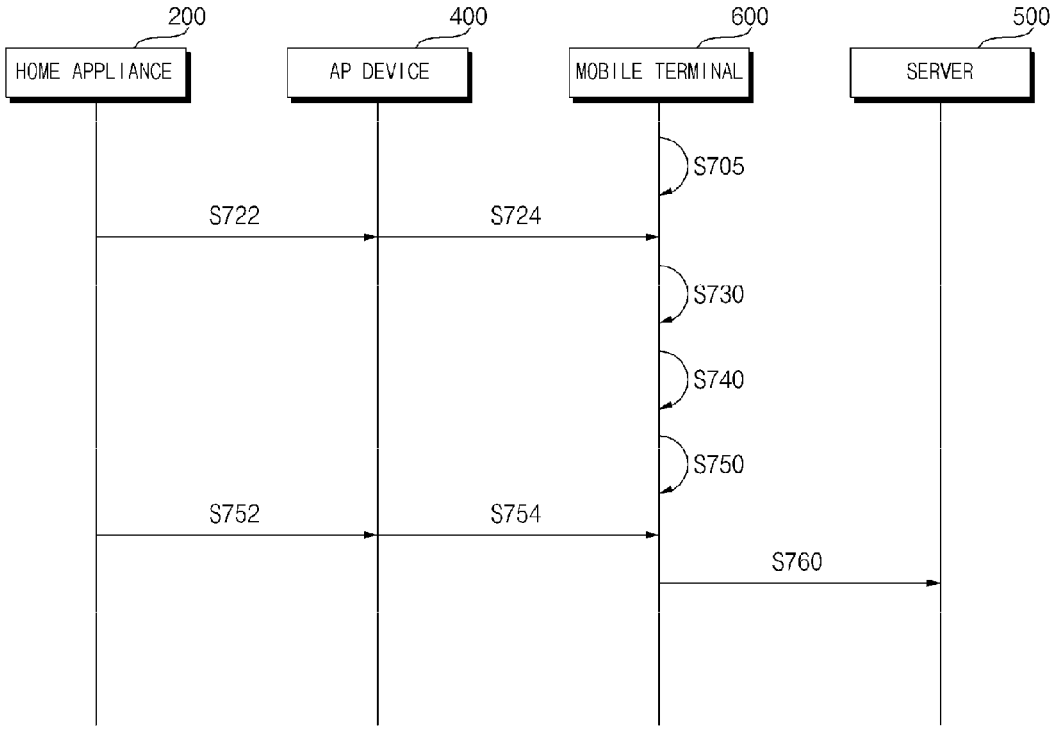
FIGS. 7 to 11J are reference views illustrating the operation method of FIG. 6.

When the home appliance integration application is executed, the mobile terminal 600 may receive information from the home appliances. Referring to FIG. 7, in a case in which the mobile terminal 600 and a home appliance 200 access the same AP device 400 in a wireless fashion, the home appliance 200 may transmit predetermined information to the AP device 400 (S722) and the AP device 400 may transmit the information to the mobile terminal 600 (S724).

At this time, the information received by the mobile terminal 600 may include product information, such as kind, name, and number of a product. In addition, the information received by the mobile terminal 600 may further include network information of the AP device assigned to the home appliance 200, product registration information of the home appliance 200, and information regarding product registration and unregistration.

The mobile terminal 600 may retrieve a home appliance not registered with the server 500 based on the above information (S630). Step S630 of FIG. 6 may correspond to step S730 of FIG. 7.

Figure 8:
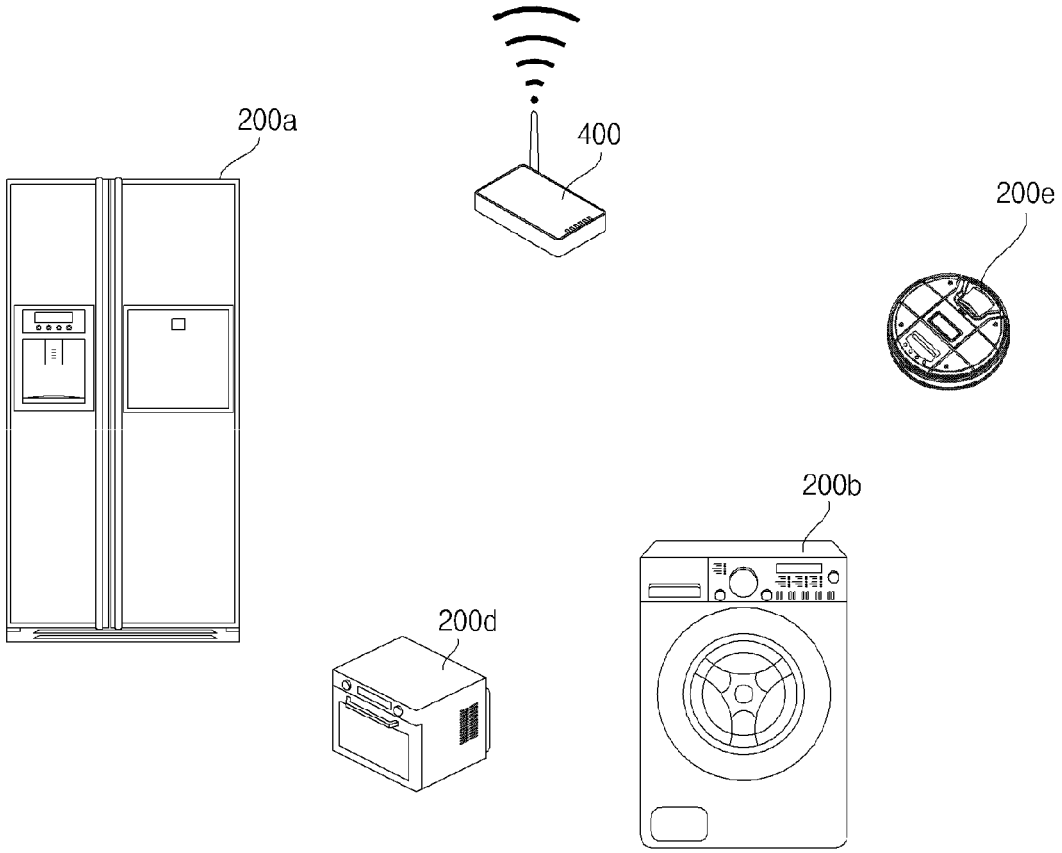

FIG. 8 illustrates that a refrigerator 200*a*, a cooking device 200*d*, a washing machine 200*b*, and a robot cleaner 200*e* access the same wireless network via the AP device 400. It is assumed that product registration for the refrigerator 200*a* and the cooking device 200*d* with the server 500 has been completed but product registration for the washing machine 200*b* and the robot cleaner 200*e* with the server 500 has not been completed.

The mobile terminal 600 may receive various kinds of information from the refrigerator 200*a*, the cooking device 200*d*, the washing machine 200*b*, and the robot cleaner 200*e* via the AP device 400. In particular, the mobile terminal 600 may receive information regarding product registration and unregistration from the server 500 to determine whether product registration for the refrigerator 200*a*, the cooking device 200*d*, the washing machine 200*b*, and the robot cleaner 200*e* with the server 500 has been performed. Alternatively, the mobile terminal 600 may receive product information from the refrigerator 200*a*, the cooking device 200*d*, the washing machine 200*b*, and the robot cleaner 200*e* via the AP device 400 and transmit the received product information to the server 500 to determine whether product registration for the refrigerator 200*a*, the cooking device 200*d*, the washing machine 200*b*, and the robot cleaner 200*e* with the server 500 has been performed.

The mobile terminal 600 may display an object indicating a retrieved unregistered home appliance on the screen (S640). Step S640 of FIG. 6 may correspond to step S740 of FIG. 7.

FIG. 9B illustrates that objects 822, 824, 826, and 828 indicating the home appliances, such as the refrigerator 200*a*, the cooking device 200*d*, the washing machine 200*b*, and the robot cleaner 200*e*, having access to the AP device 400 in the same network, are simultaneously displayed on the same screen.

At this time, the mobile terminal 600 may determine whether product registration for the refrigerator 200*a*, the cooking device 200*d*, the washing machine 200*b*, and the robot cleaner 200*e* with the server 500 has been performed and distinguishably display the objects 822 and 824 indicating the refrigerator 200*a* and the cooking device 200*d*, which are products registered with the server 500, and the objects 826 and 828 indicating the washing machine 200*b* and the robot cleaner 200*e*, which are products not registered with the server 500. It can be seen from the drawing that luminance of the objects 826 and 828 indicating the washing machine 200*b* and the robot cleaner 200*e* is relatively low.

In addition, a message 830 informing that unregistered devices are present may be displayed on the objects 826 and 828 indicating the washing machine 200*b* and the robot cleaner 200*e* in an overlapping fashion. The message 830 may be a message to guide registration of the retrieved unregistered home appliances.

In addition, the objects 826 and 828 indicating the washing machine 200*b* and the robot cleaner 200*e* may include icons 827 and 829 for product registration, respectively.

FIG. 9B illustrates that the objects indicating the respective home appliances are arranged and displayed in the order registered with the server. Consequently, it is possible for a user to easily and conveniently confirm whether the respective home appliances have been registered with the server.

Subsequently, upon receiving an input to register an unregistered home appliance (S650), the mobile terminal 600 transmits product information of the unregistered home appliance to the server (S660). Step S650 of FIG. 6 may correspond to step S750 of FIG. 7 and Step S660 of FIG. 6 may correspond to step S760 of FIG. 7.

Figure 9C:
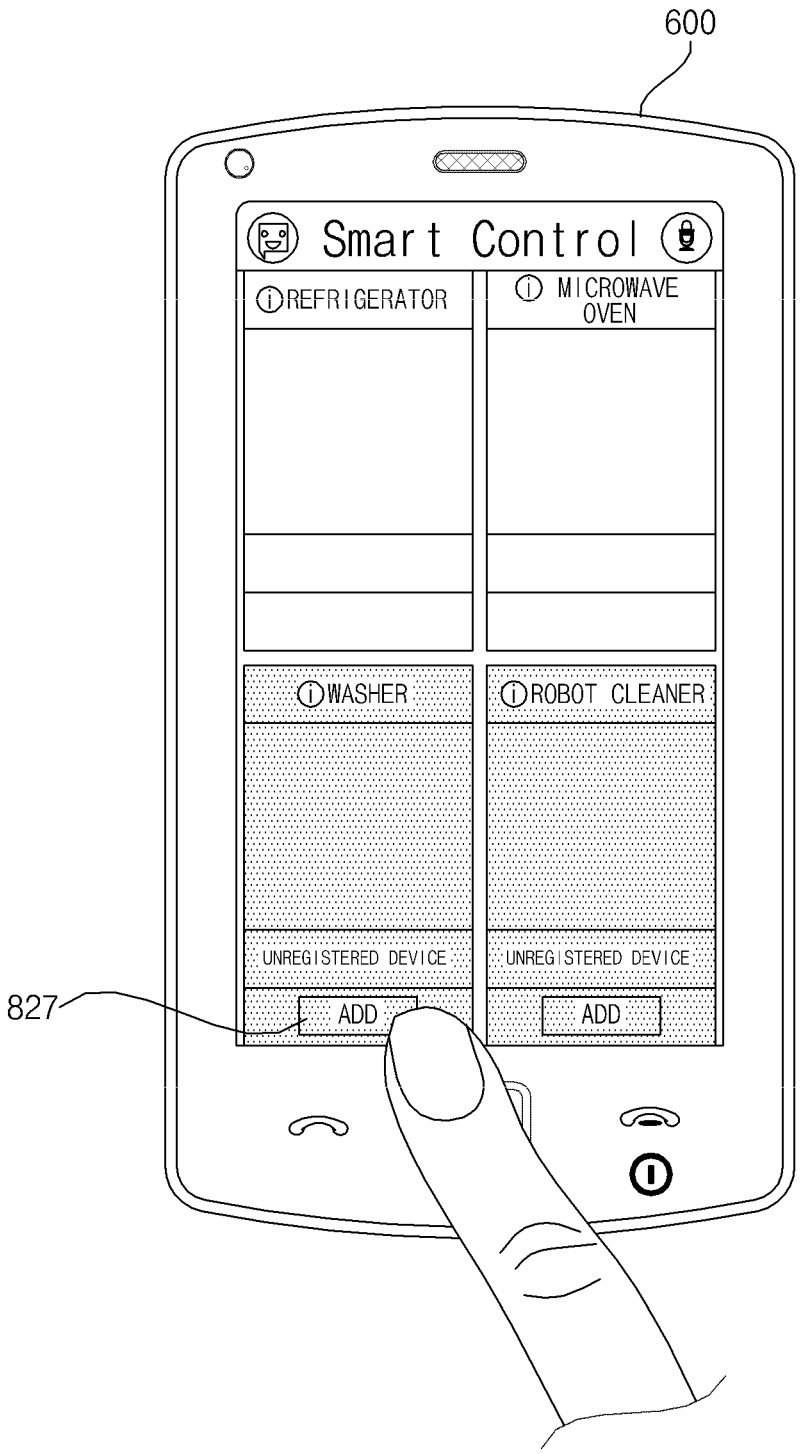
Figure 9D:
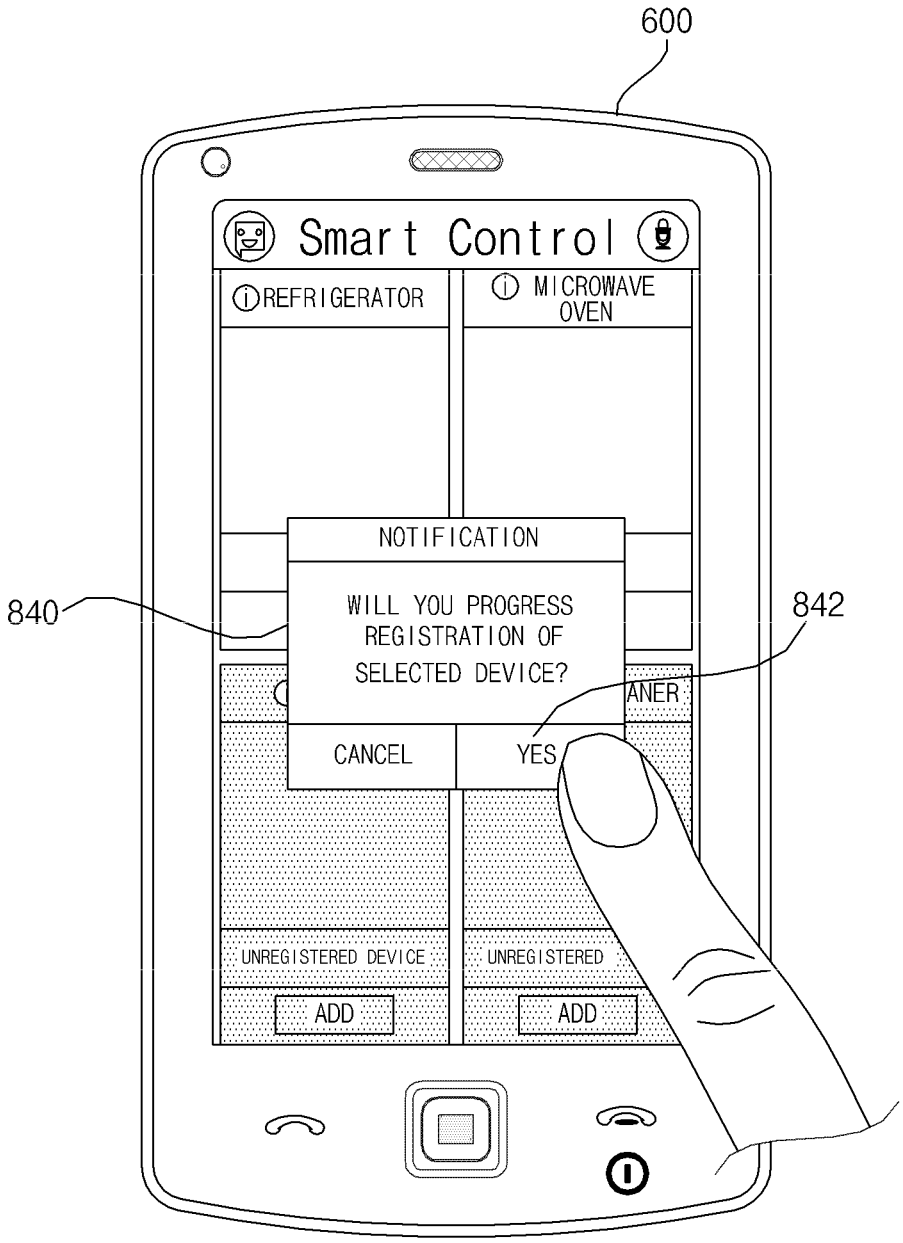
Figure 9E:
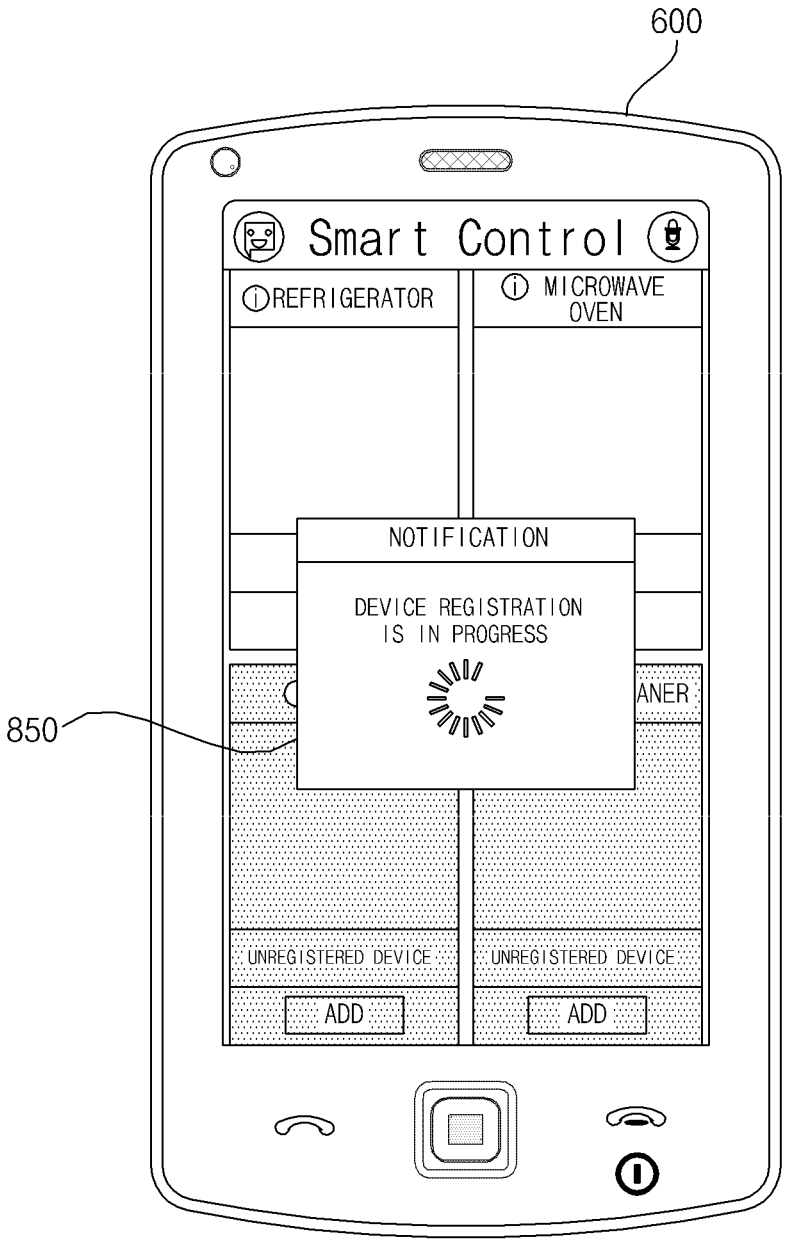

When the user selects the icon 827 for product registration as shown in FIG. 9C, a message 840 informing as to whether registration of the selected device will progress may be displayed in an overlapping fashion as shown in FIG. 9D. When the user selects a progress item 842, product information of the washing machine 200*b* may be transmitted to the server 500. In this case, a message 850 informing that product registration for the washing machine 200*b* is in progress may be displayed in an overlapping fashion as shown in FIG. 9E.

Figure 9F:
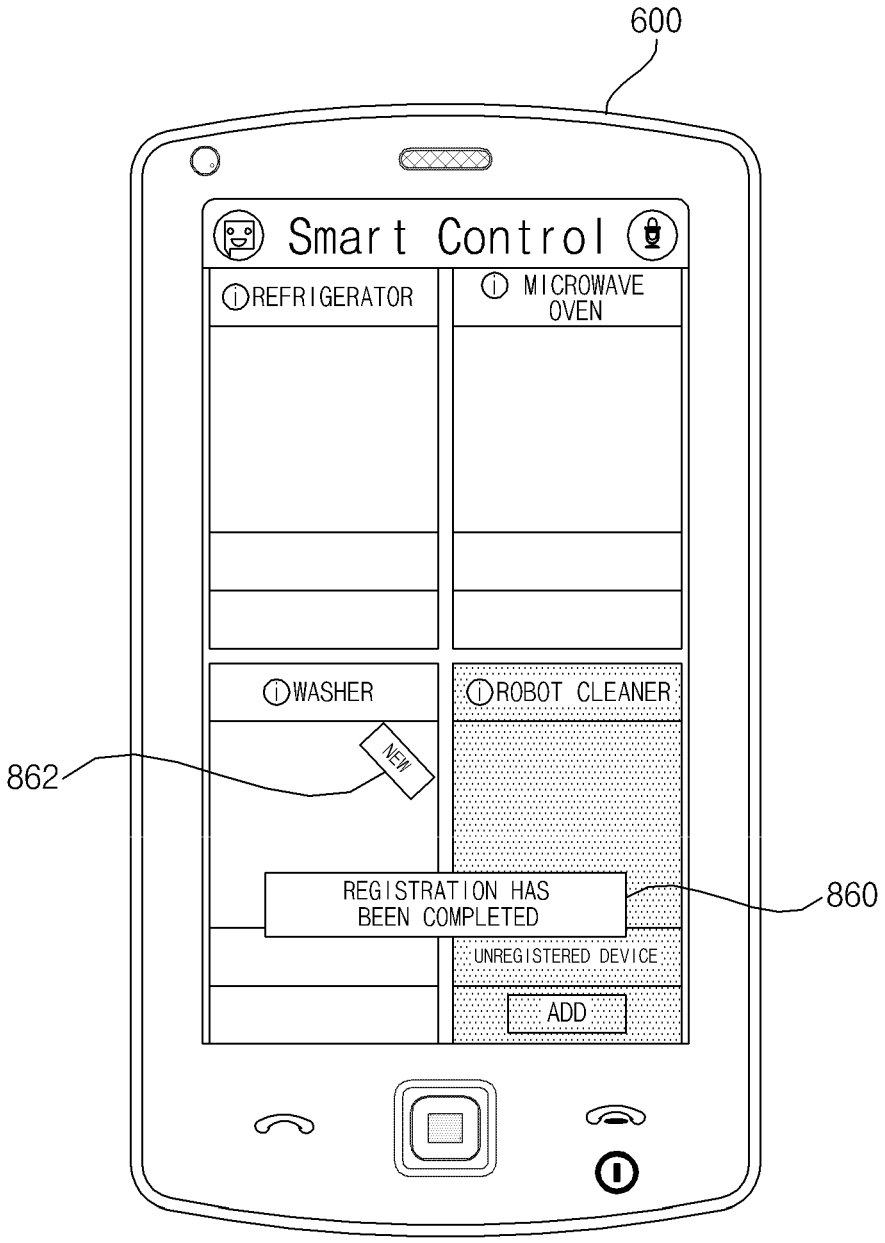

Upon completion of the product registration, the mobile terminal 600 may receive product registration completion information from the server 500 and a product registration completion message 860 may be displayed based on the received product registration completion information as shown in FIG. 9F.

In addition, an icon 862 indicating new product registration may be provided in the object 826 indicating the washing machine 200*b*. As a result, it is possible for the user to immediately confirm the completion of product registration.

Figure 9G:
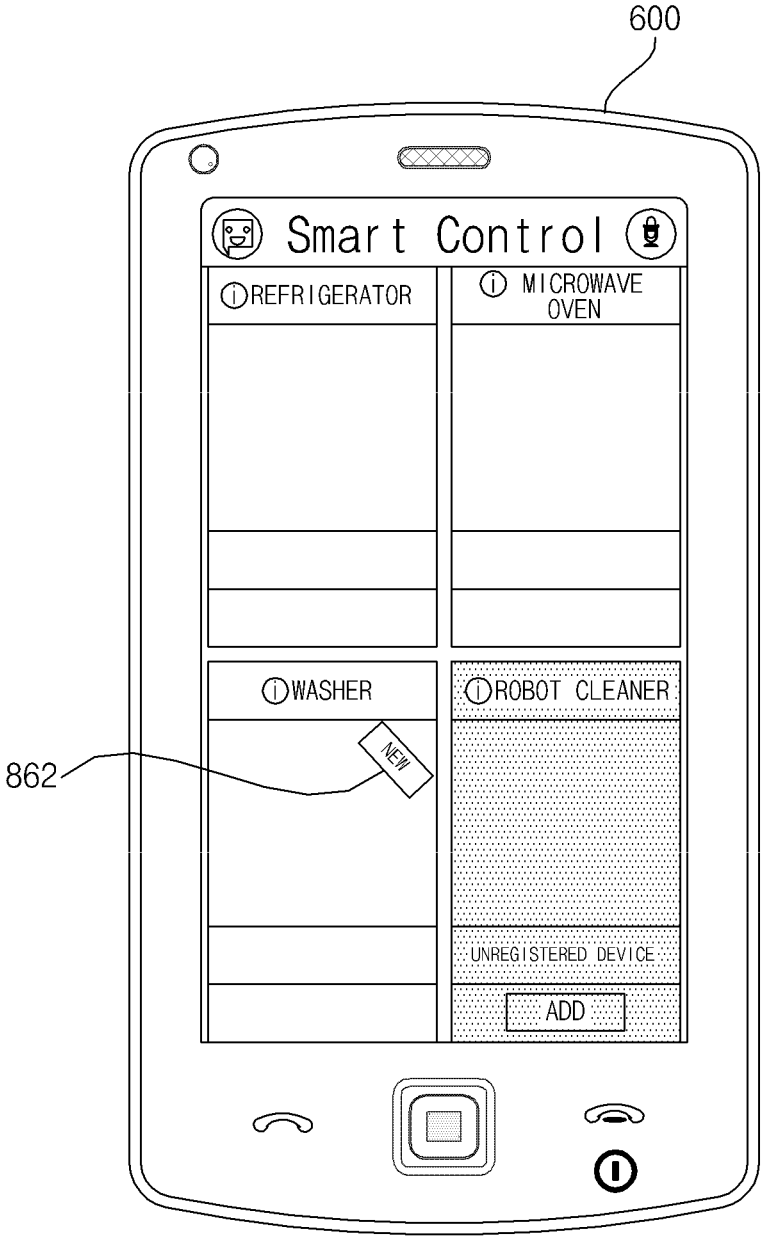

As shown in FIG. 9G, the product registration completion message 860 may disappear after the lapse of a predetermined time and the icon 862 indicating new product registration may be displayed in the object 826 indicating the washing machine 200*b*.

On the other hand, upon receiving an input to register an unregistered home appliance (S650), the mobile terminal 600 may receive product information from the home appliances. Referring to FIG. 7, in a case in which the mobile terminal 600 and the home appliance 200 access the same AP device 400 in a wireless fashion, the home appliance 200 may transmit the product information to the AP device 400 (S752) and the AP device 400 may transmit the product information to the mobile terminal 600 (S754).

FIGS. 10A to 10H illustrate product registration for home appliances belonging to the same product group in a case in which the home appliances access a network.

Figure 10A:
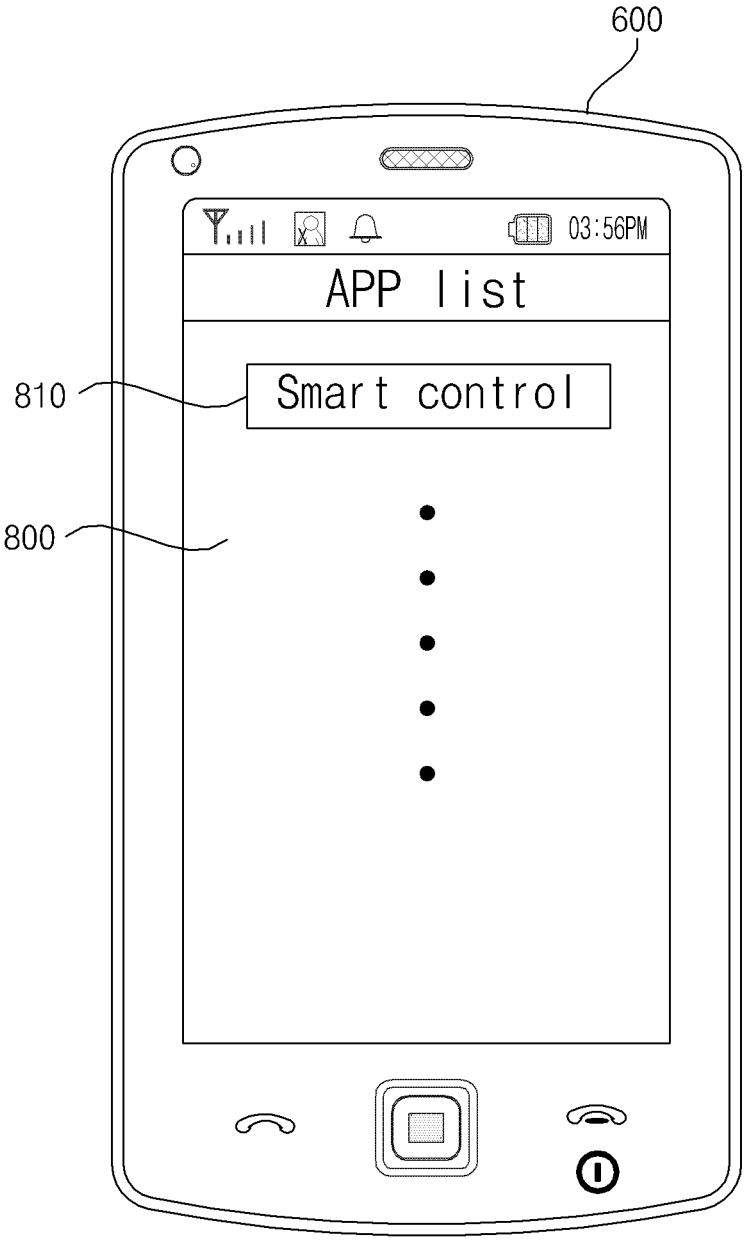

FIG. 10A illustrates that an application list screen 800 related to home appliances is displayed on the mobile terminal 600.

Figure 10B:
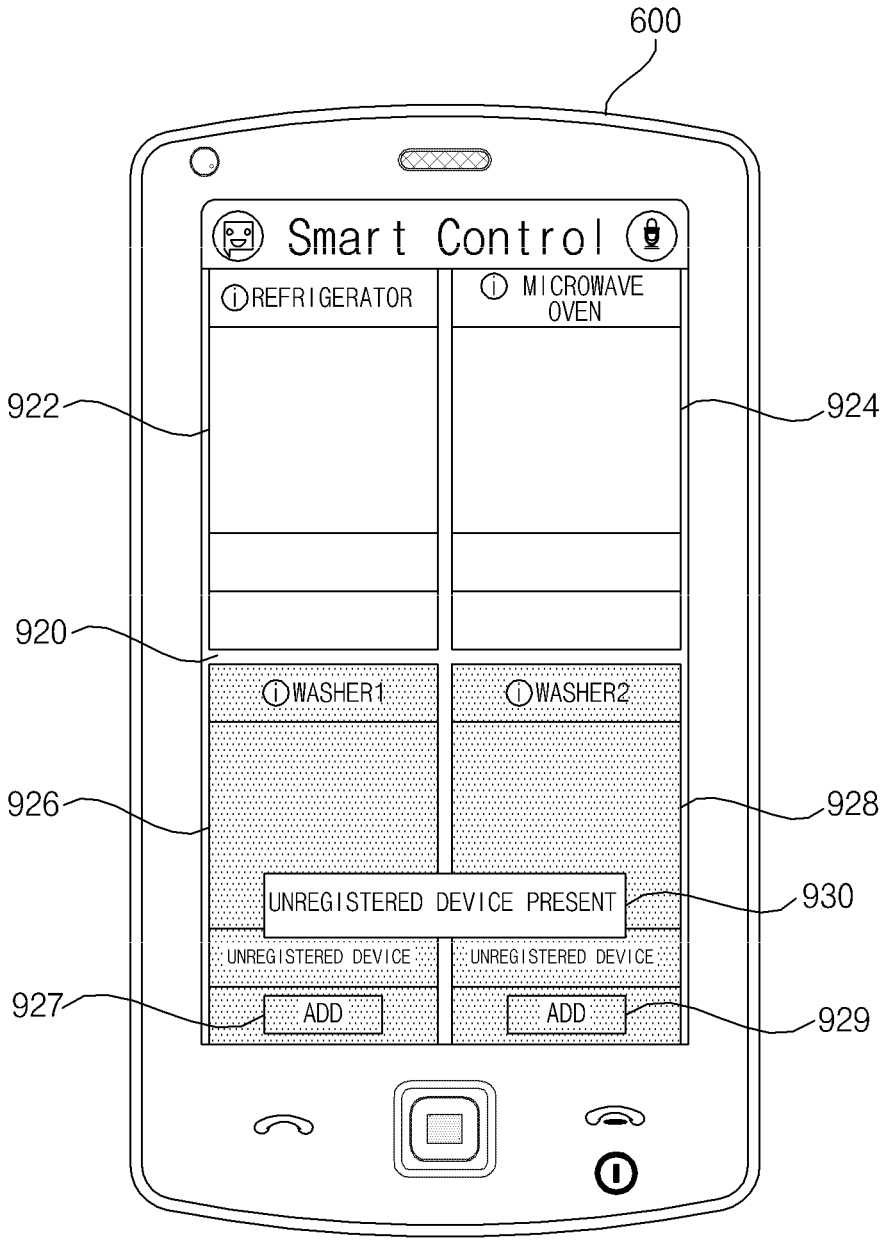

When a user selects a smart control item 810, a home appliance integration application to control the home appliances may be executed. FIG. 10B illustrates that objects 922, 924, 926, and 928 indicating a plurality of home appliances are simultaneously displayed on the same screen.

In particular, it is illustrated that a refrigerator 200*a*, a cooking device 200*d*, and two washing machines access the same wireless network via the AP device 400. It is assumed that product registration for the refrigerator 200*a* and the cooking device 200*d* with the server 500 has been completed but product registration for the two washing machines with the server 500 has not been completed.

The mobile terminal 600 may receive various kinds of information from the refrigerator 200*a*, the cooking device 200*d*, and the two washing machines via the AP device 400. In particular, the mobile terminal 600 may receive information regarding product registration and unregistration from the server 500 to determine whether product registration for the refrigerator 200*a*, the cooking device 200*d*, and the two washing machines with the server 500 has been performed. Alternatively, the mobile terminal 600 may receive product information from the refrigerator 200*a*, the cooking device 200*d*, and the two washing machines via the AP device 400 and transmit the received product information to the server 500 to determine whether product registration for the refrigerator 200*a*, the cooking device 200*d*, and the two washing machines with the server 500 has been performed.

The mobile terminal 600 may display an object indicating a retrieved unregistered home appliance on the screen (S640). Step S640 of FIG. 6 may correspond to step S740 of FIG. 7.

FIG. 10B illustrates that objects 922, 924, 926, and 928 indicating the home appliances, such as the refrigerator 200*a*, the cooking device 200*d*, and the two washing machines, having access to the AP device 400 in the same network, are simultaneously displayed on the same screen.

At this time, the mobile terminal 600 may determine whether product registration for the refrigerator 200*a*, the cooking device 200*d*, and the two washing machines with the server 500 has been performed and distinguishably display the objects 922 and 924 indicating the refrigerator 200*a* and the cooking device 200*d*, which are products registered with the server 500, and the objects 926 and 928 indicating the two washing machines, which are products not registered with the server 500. It can be seen from the drawing that luminance of the objects 926 and 928 indicating the two washing machines is relatively low.

In addition, a message 930 informing that unregistered devices are present may be displayed on the objects 926 and 928 indicating the two washing machines in an overlapping fashion. The message 930 may be a message to guide registration of the retrieved unregistered home appliances.

In addition, the objects 926 and 928 indicating the two washing machines may include icons 927 and 929 for product registration, respectively.

FIG. 10B illustrates that the objects indicating the respective home appliances are arranged and displayed in the order registered with the server. Consequently, it is possible for a user to easily and conveniently confirm whether the respective home appliances have been registered with the server.

Figure 10C:
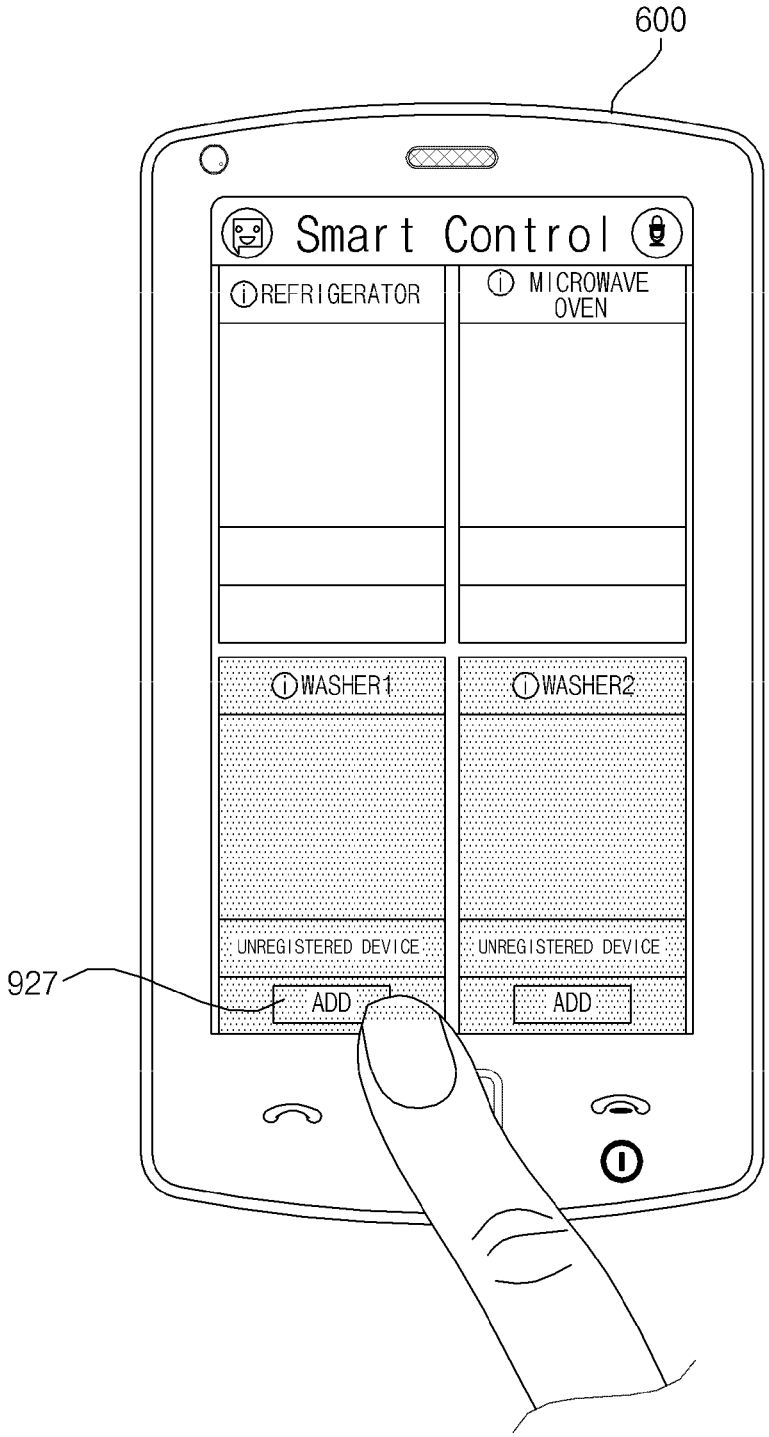
Figure 10D:
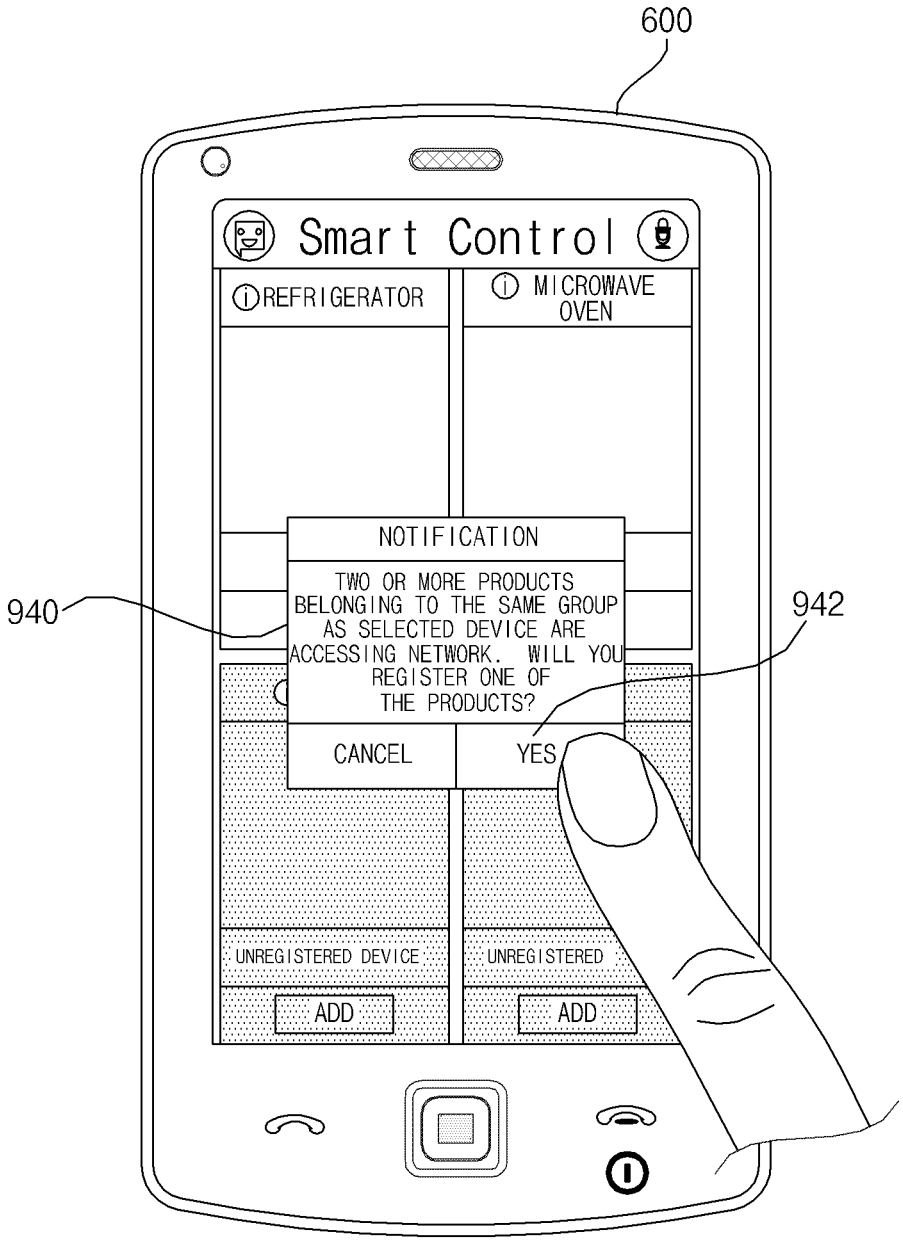
Figure 10E:
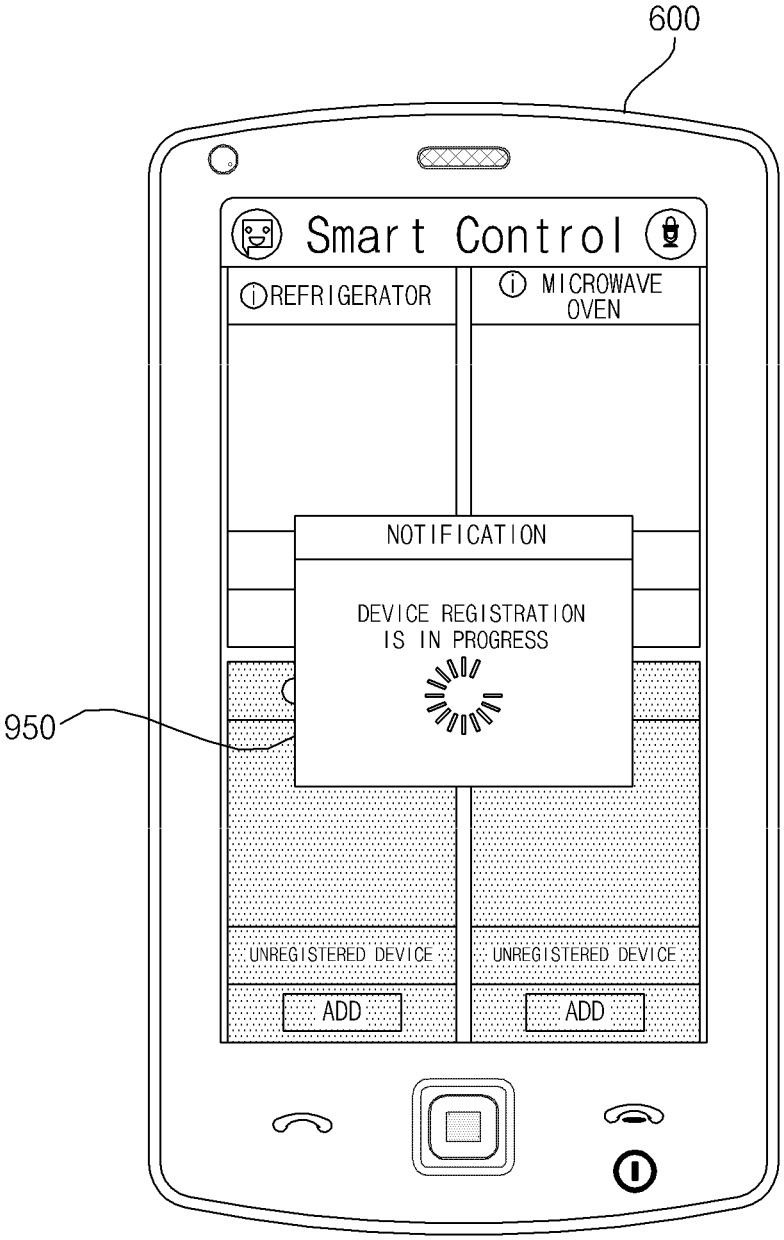

When the user selects the icon 927 for product registration as shown in FIG. 10C, a message 940 informing that two or more products belonging to the same group as the selected device are accessing the network and whether registration of one of the products will be progressed may be displayed in an overlapping fashion as shown in FIG. 10D. When the user selects a progress item 942, product information of one of the washing machines may be transmitted to the server 500. In this case, a message 950 informing that product registration for one of the washing machines is in progress may be displayed in an overlapping fashion as shown in FIG. 10E.

Figure 10F:
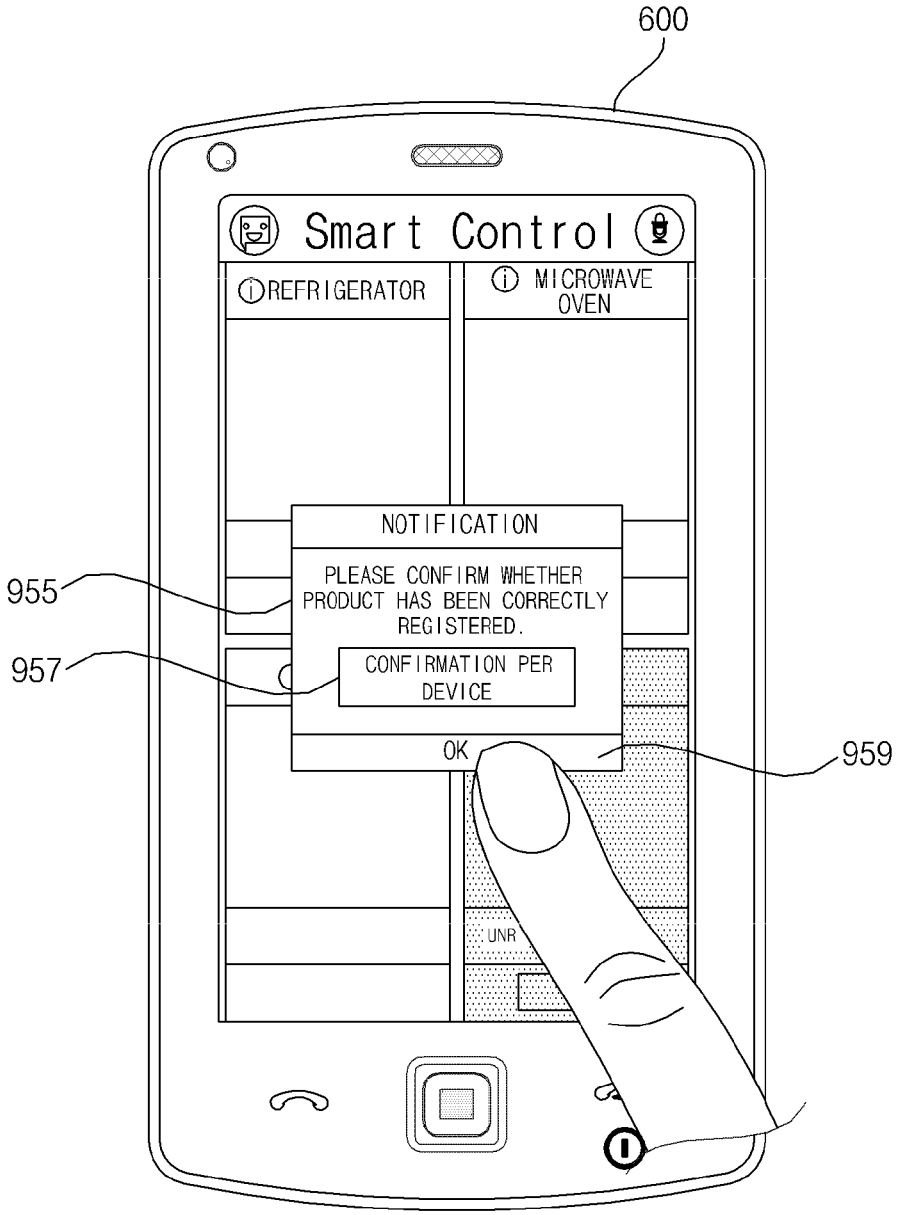

Upon completion of the product registration, the mobile terminal 600 may receive product registration completion information from the server 500 and a message 955 to guide confirmation of correct registration may be displayed in an overlapping fashion as shown in FIG. 10F. At this time, the message 955 may include a confirmation-per-device item 957 and an OK item 959.

Figure 10G:
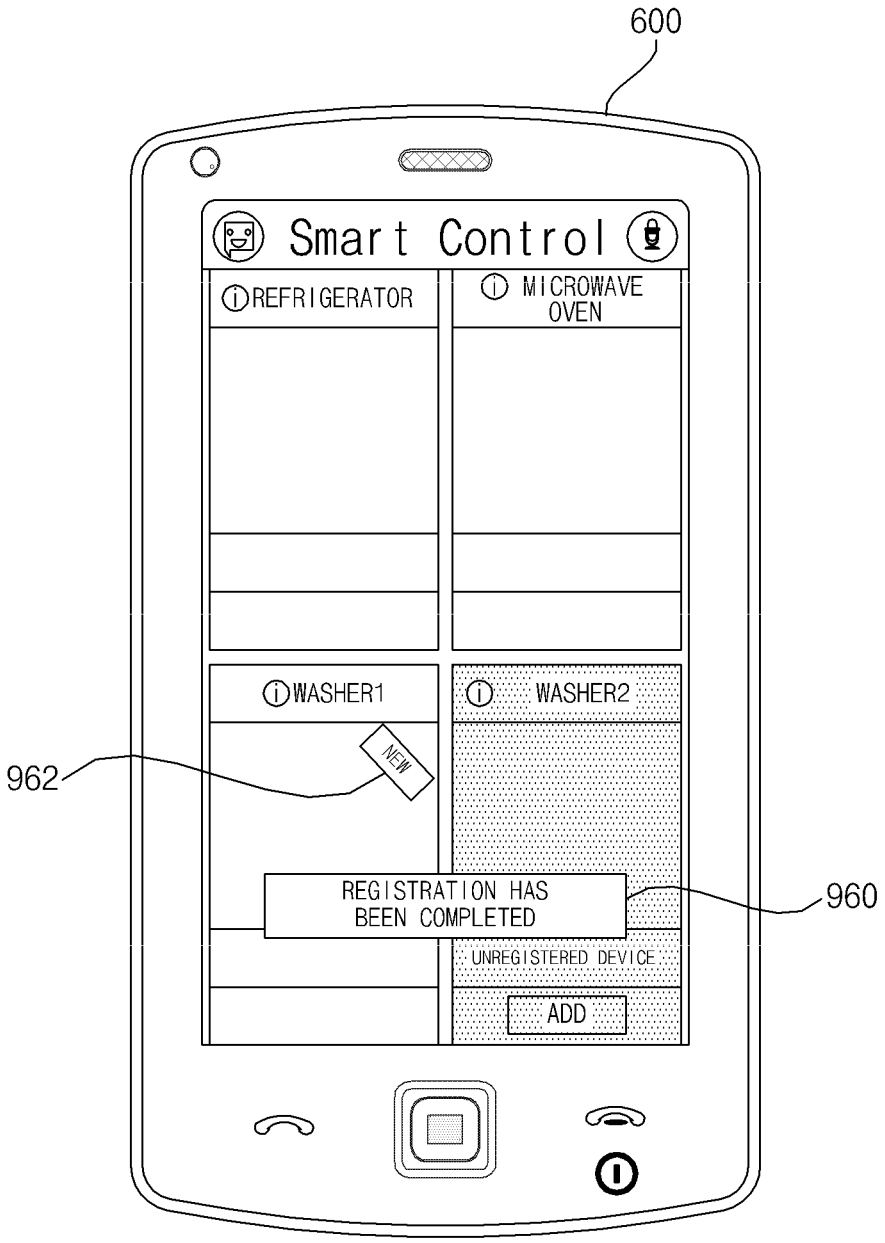

When the user selects the OK item 959, a product registration completion message 860 for one of the two washing machines, e.g., a first washing machine, may be displayed as shown in FIG. 10G.

In addition, an icon 962 indicating new product registration may be provided in the object 926 indicating the first washing machine. As a result, it is possible for the user to immediately confirm the completion of product registration.

Figure 10H:
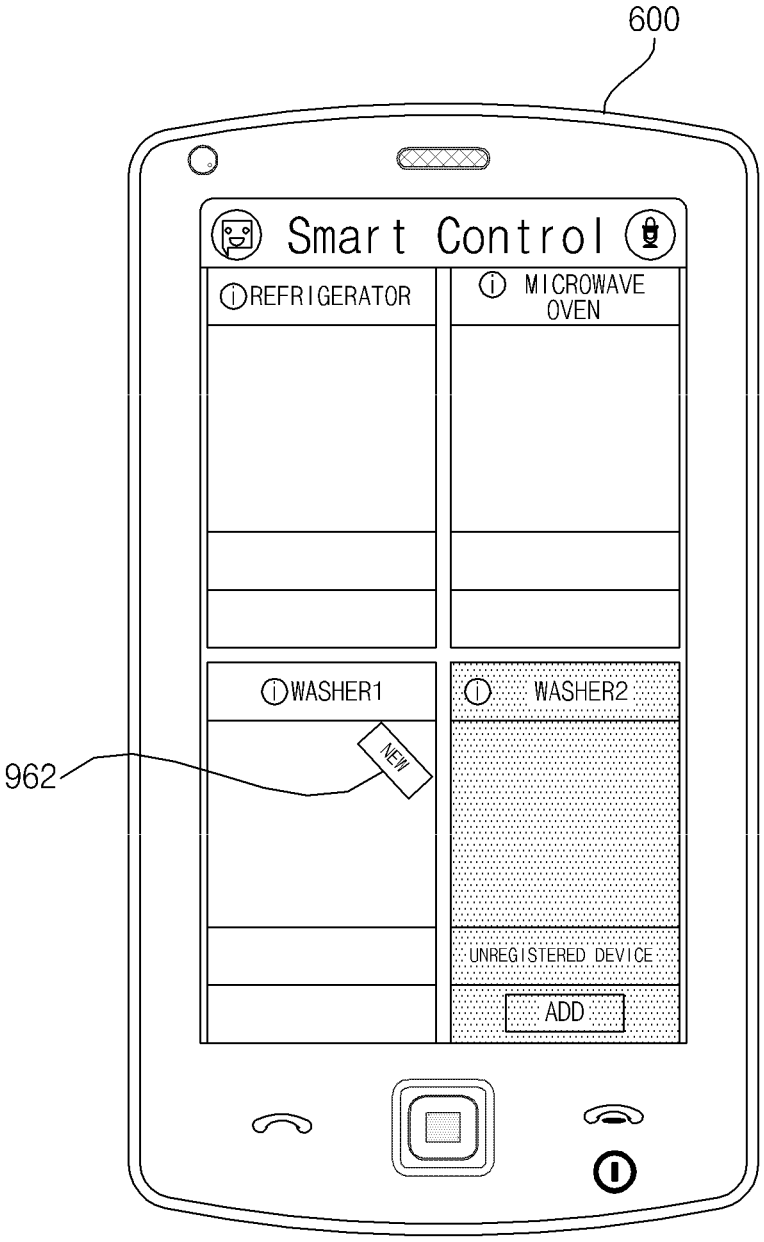

As shown in FIG. 10H, the product registration completion message 960 may disappear after the lapse of a predetermined time and the icon 962 indicating new product registration may be displayed in the object 926 indicating the first washing machine.

Meanwhile, the refrigerator 200*a*, the cooking device 200*d*, the washing machine 200*b*, and the robot cleaner 200*e* access the AP device 400 as illustrated in FIG. 9B. Hereinafter, an example of a method of network access to the AP device 400 in a case in which home appliances do not access the AP device 400 will be described. That is, the refrigerator 200*a*, the cooking device 200*d*, the washing machine 200*b*, and the robot cleaner 200*e* illustrated in FIG. 9B may access the AP device 400 using a network access method as hereinafter described.

Figure 11A:
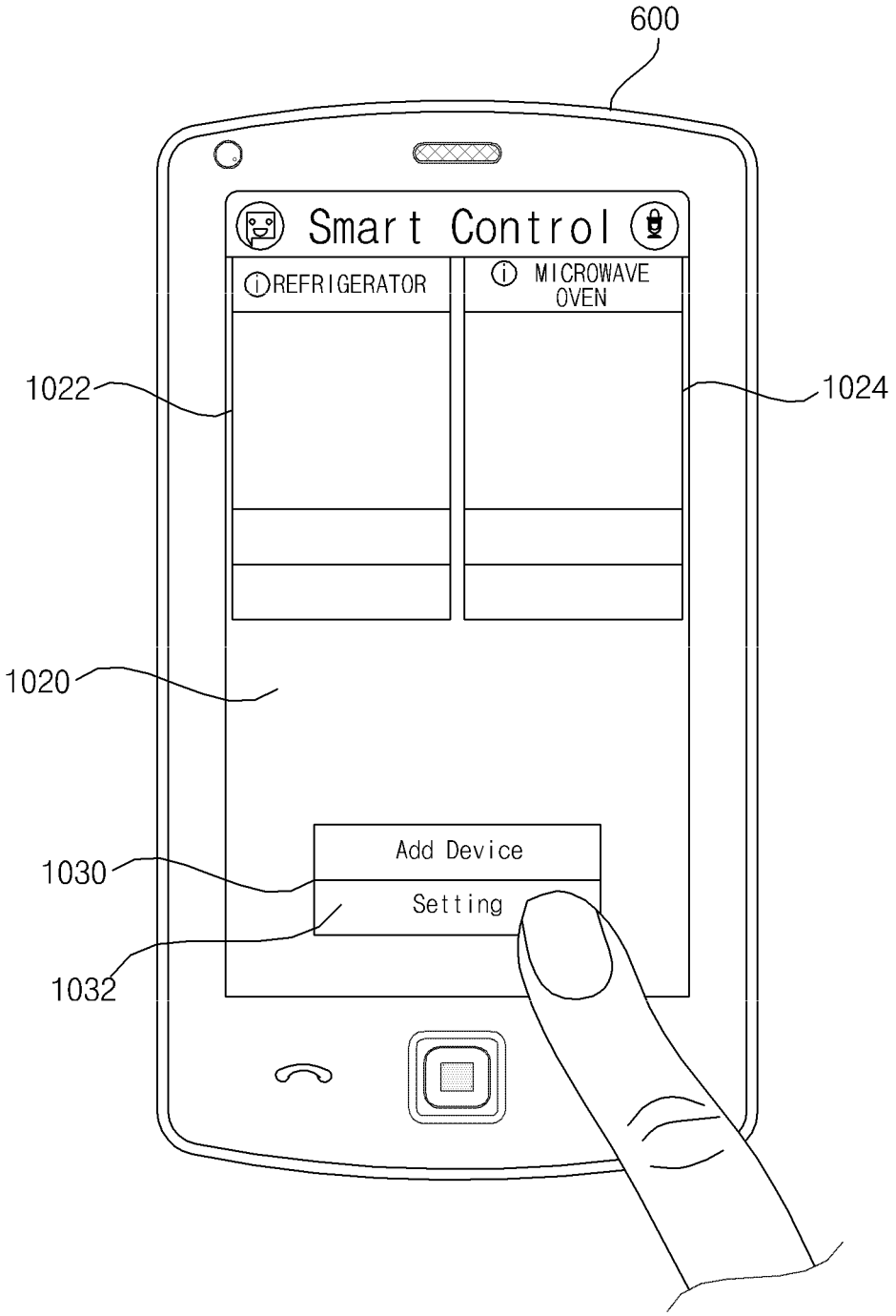

FIG. 11A illustrates an application screen 1020 related to home appliances. Specifically, FIG. 11A illustrates a refrigerator 200*a* and a cooking device 200*d* as home appliances having accessed a network. In addition, FIG. 11A illustrates that objects 1022 and 1024 indicating the refrigerator 200*a* and the cooking device 200*d* are displayed.

At this time, as shown in FIG. 11A, an addition item 1030 and a setting item 1032 for access of a home appliance to the network may be further displayed in the application screen 1020.

Figure 11B:
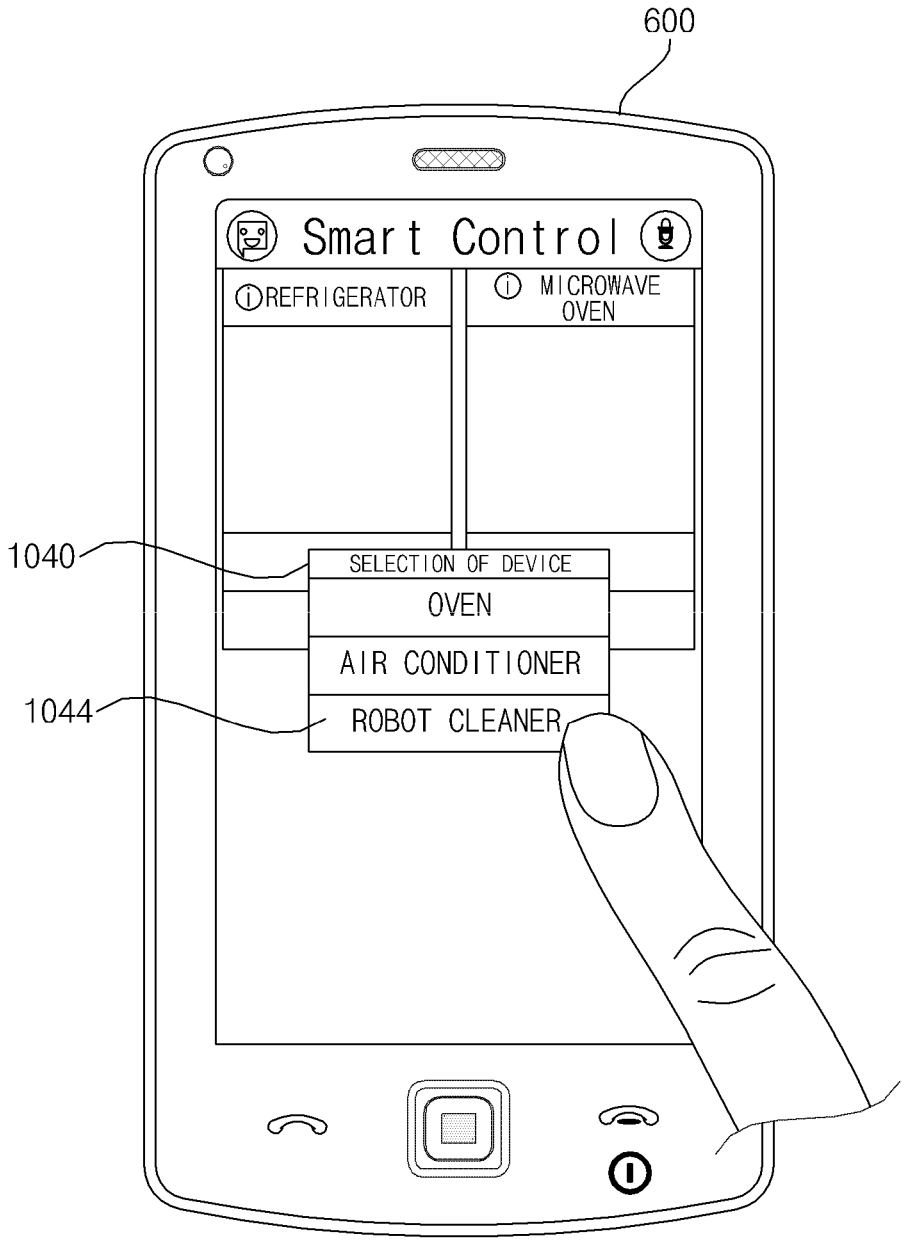

When a user selects the addition item 1030, a home appliance selection window 1040 may be displayed as shown in FIG. 11B. As shown in FIG. 11B, a cooking device item, an air conditioner item, and a robot cleaner item are displayed in the home appliance selection window 1040.

Figure 11C:
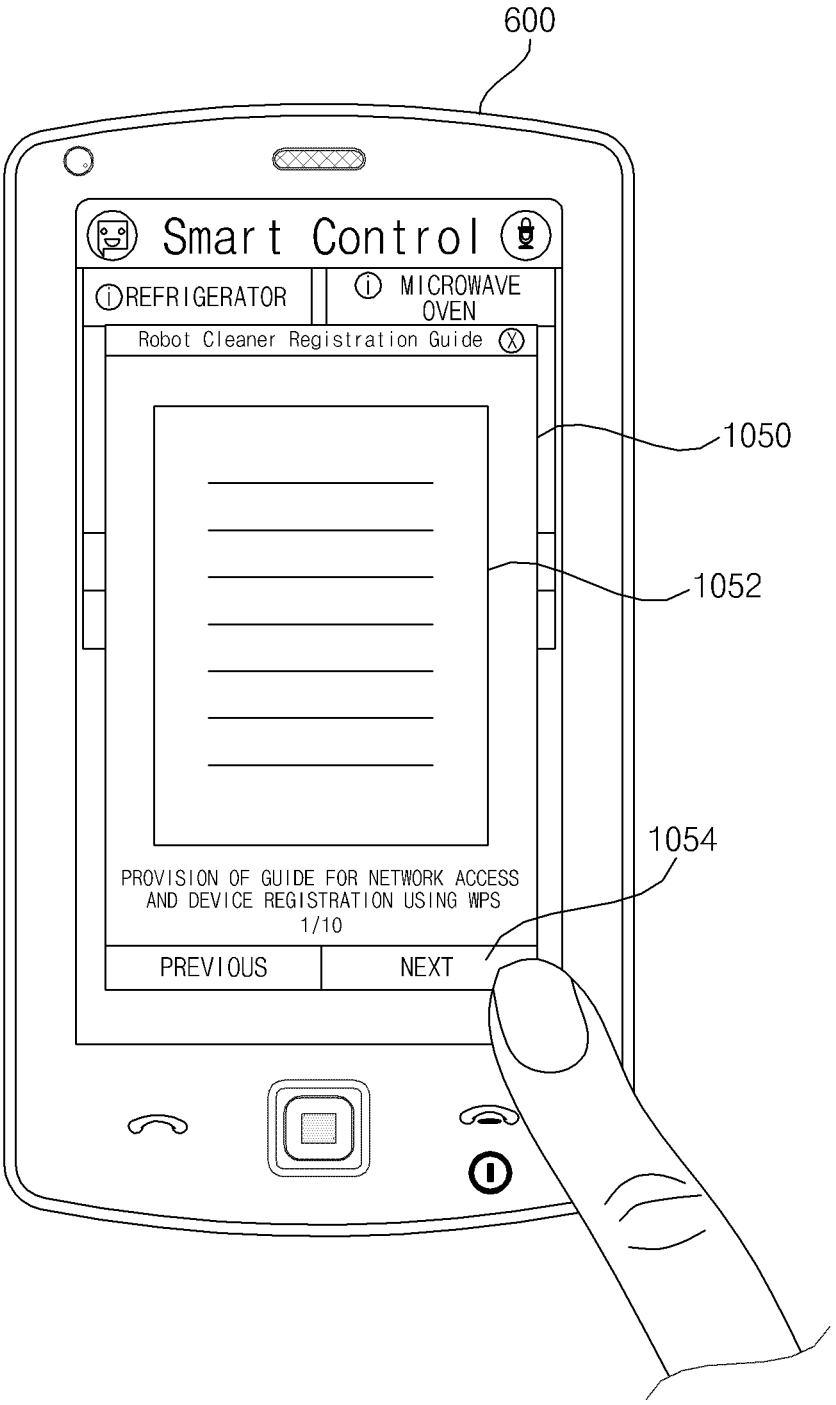

When the user selects the robot cleaner item 1044, a network access guide message window 1050 may be displayed as shown in FIG. 11C. In particular, the guide message window 1050 may include a guide message 1052 to guide Wi-Fi protected setup (WPS). When the user selects a next item 1054, a next guide message 1053 may be displayed as shown in FIG. 11D.

In a case in which the user reads the guide message displayed in the guide message window 1050, pushes a WPS button (not shown) provided at the robot cleaner for a predetermined time, and pushes a WPS button (not shown) of the AP device 400, data exchange may be automatically performed between the AP device 400 and the robot cleaner. In addition, network access may progress.

Figure 11D:
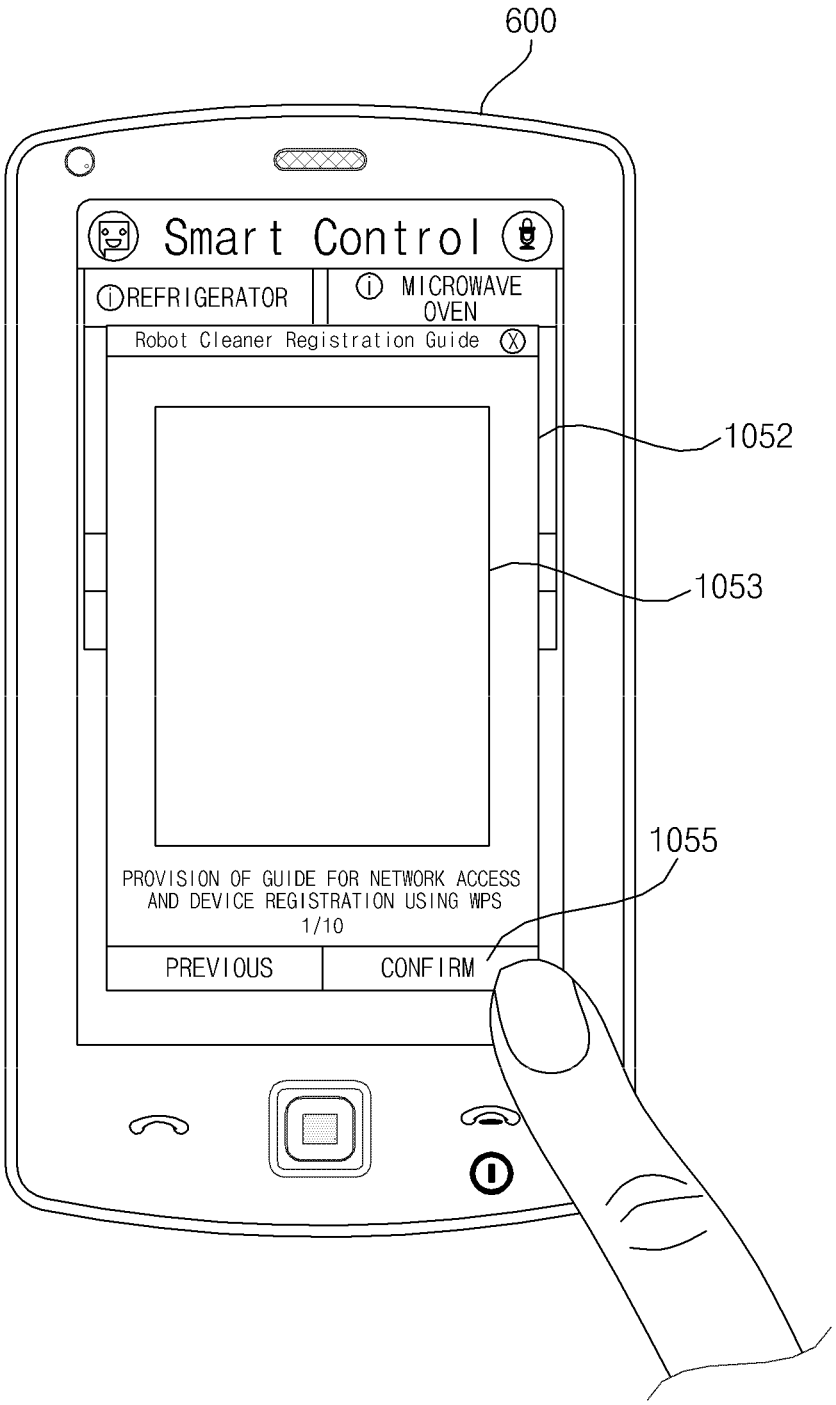
Figure 11E:
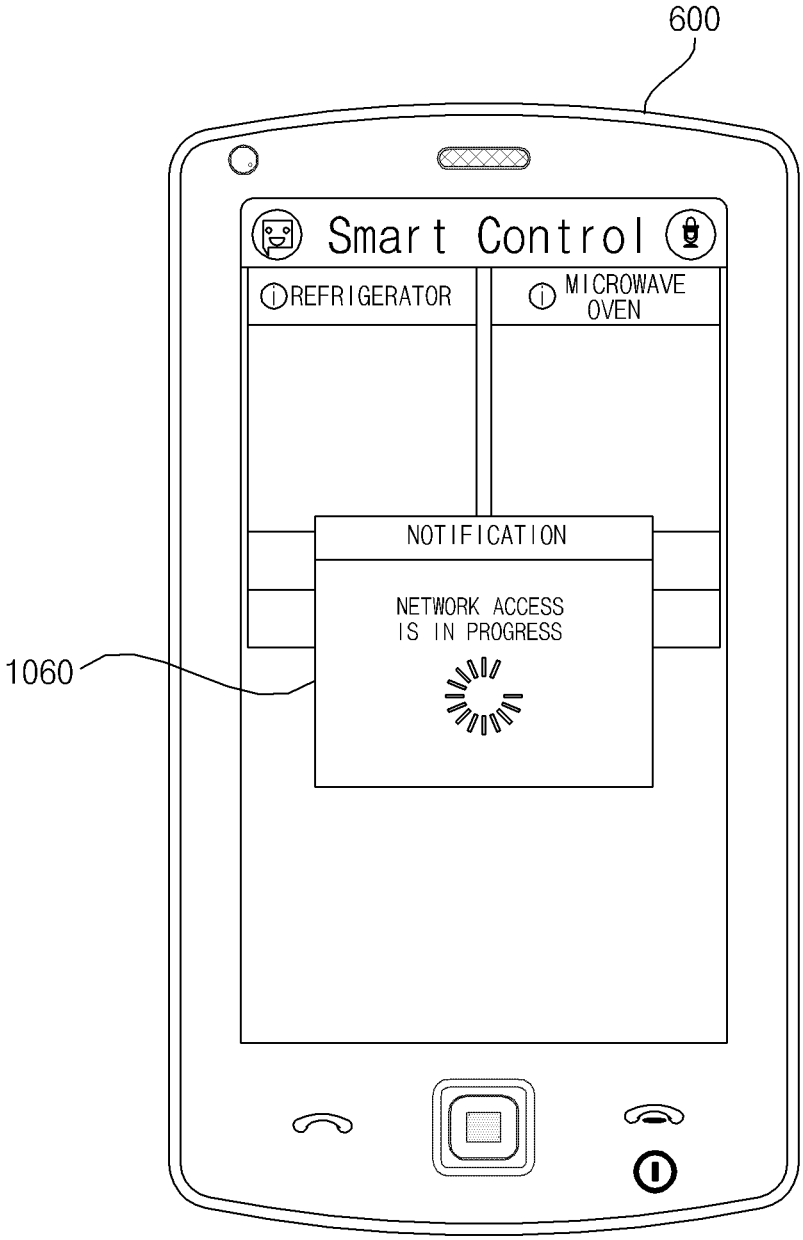

When the user selects a confirmation item 1055 in a state of the guide message 1053 of FIG. 11D or when data exchange is automatically performed between the AP device 400 and the robot cleaner, the mobile terminal 600 may display a message 1060 indicating that network access is in progress as shown in FIG. 11E.

Figure 11F:
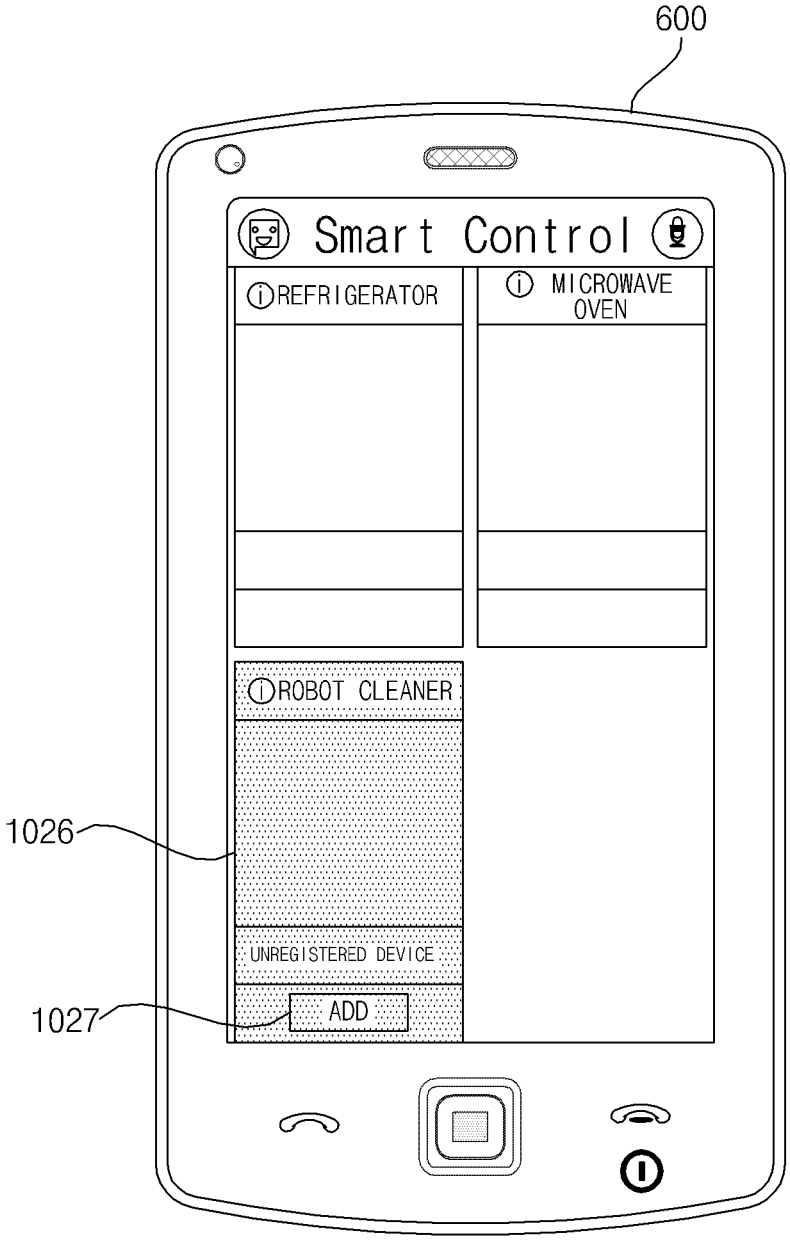

Upon completion of the network setup, an object 1026 indicating the robot cleaner may be displayed in addition to the objects 1022 and 1024 as shown in FIG. 11F. At this time, the object 1026 indicating the robot cleaner is an object indicating an unregistered product. For this reason, the object 1026 indicating the robot cleaner may be distinguishably displayed at lower luminance than the other objects 1022 and 1024. In addition, the object 1026 indicating the robot cleaner may be displayed at the lower end of the screen. Meanwhile, the object 1026 indicating the robot cleaner may further include an icon 1027 for product registration.

Figure 11G:
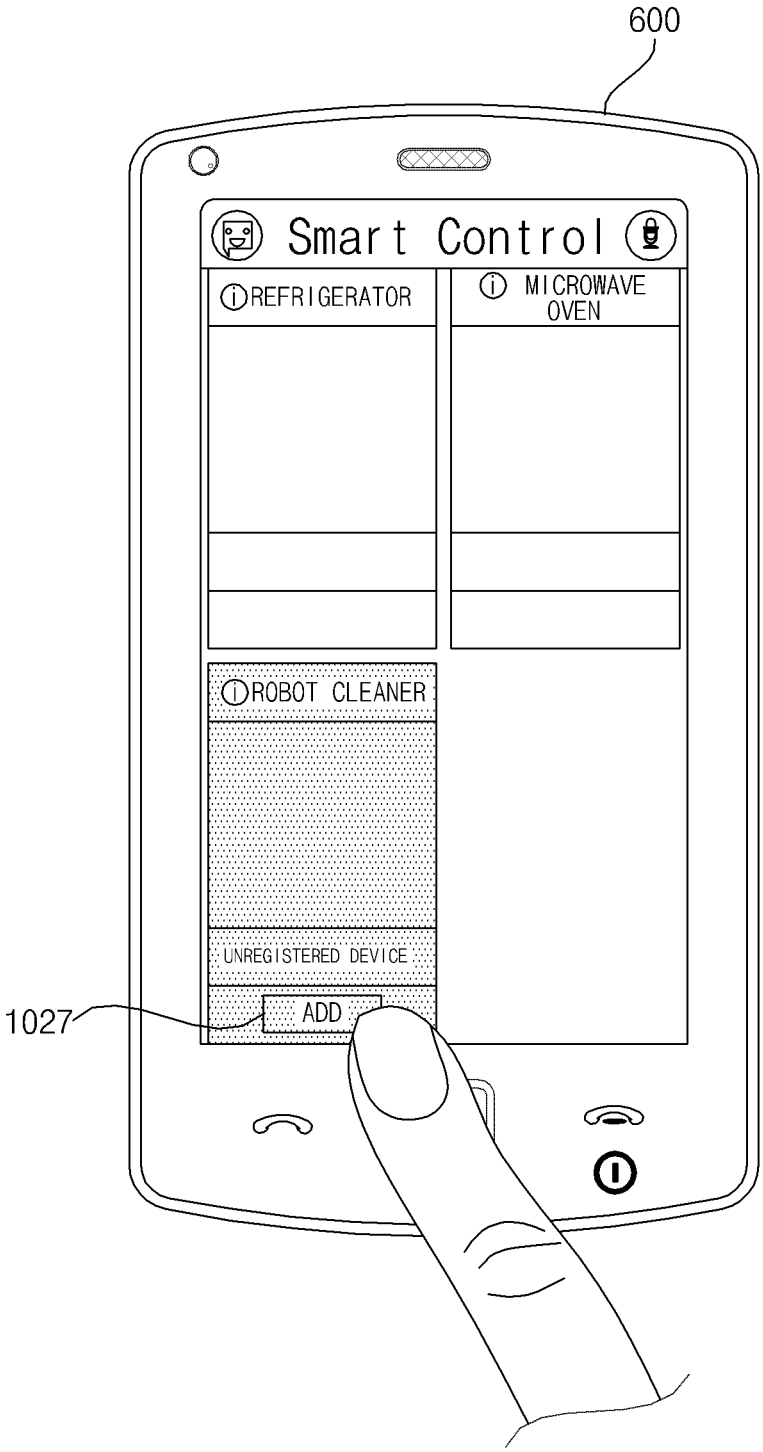
Figure 11H:
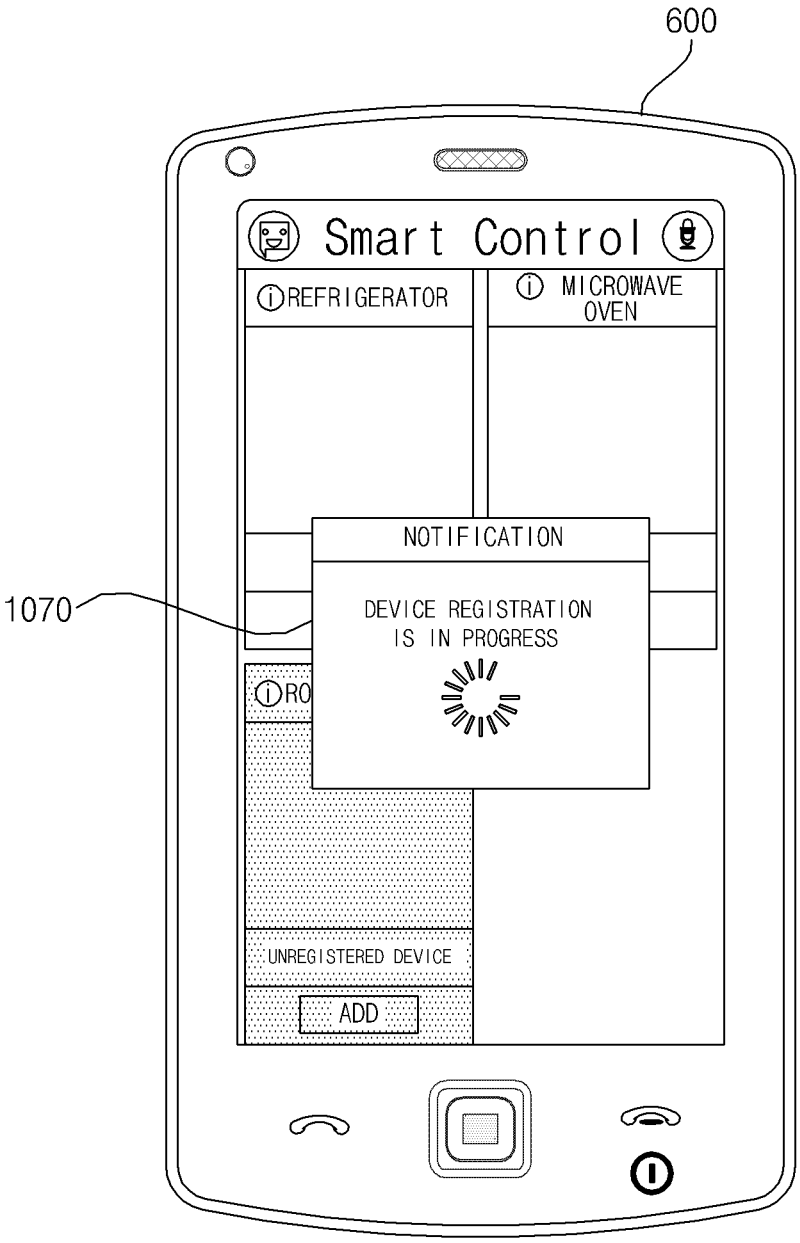

When the user selects the icon 1027 for product registration as shown in FIG. 11G, a message 1070 indicating that product registration for the robot cleaner 200*e* is in progress may be displayed in an overlapping fashion as shown in FIG. 11H.

Figure 11I:
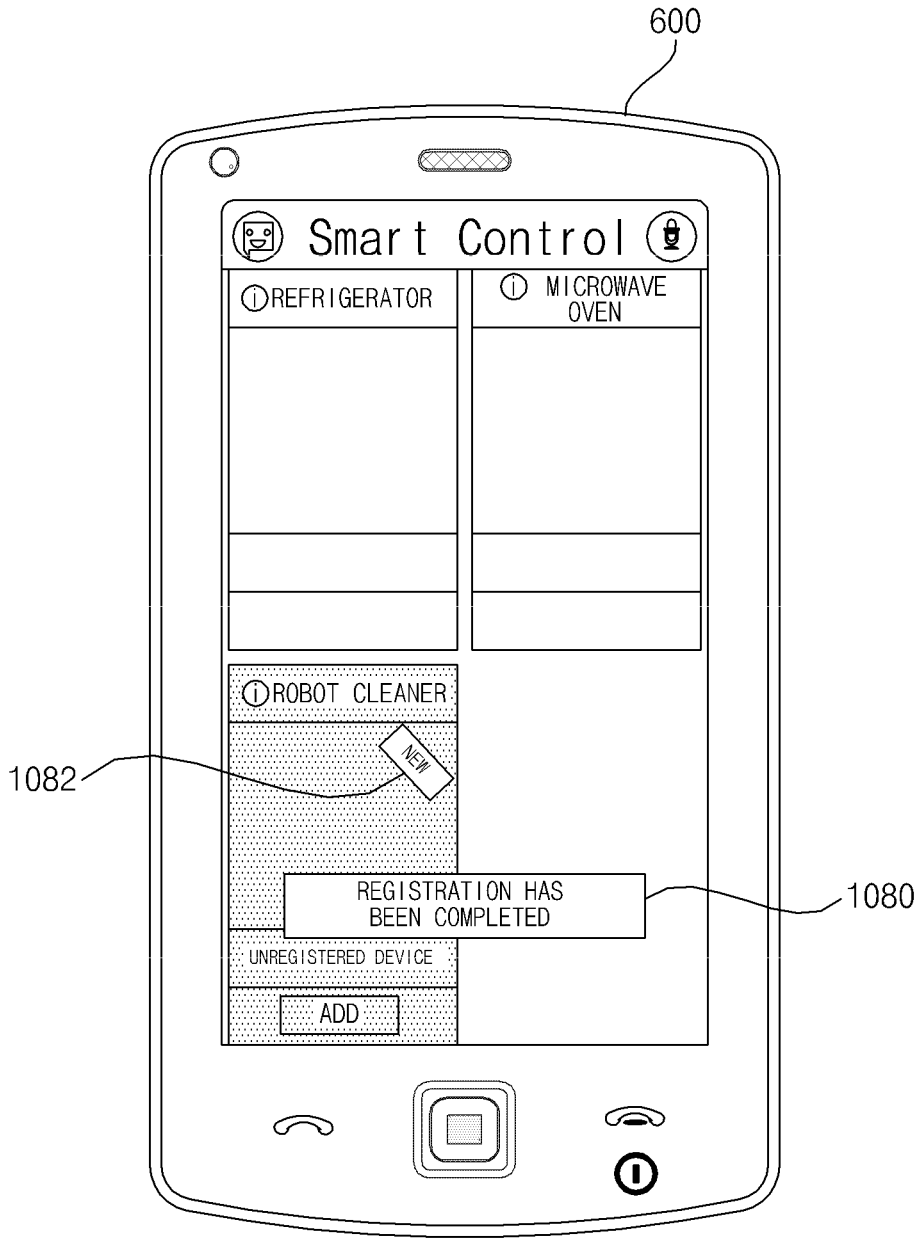

Upon completion of the product registration, the mobile terminal 600 may receive product registration completion information from the server 500 and a product registration completion message 1080 for the robot cleaner 200*e* may be displayed as shown in FIG. 11I.

In addition, an icon 1082 indicating new product registration may be provided in the object 1026 indicating the robot cleaner 200*e*. As a result, it is possible for the user to immediately confirm the completion of product registration.

Figure 11J:
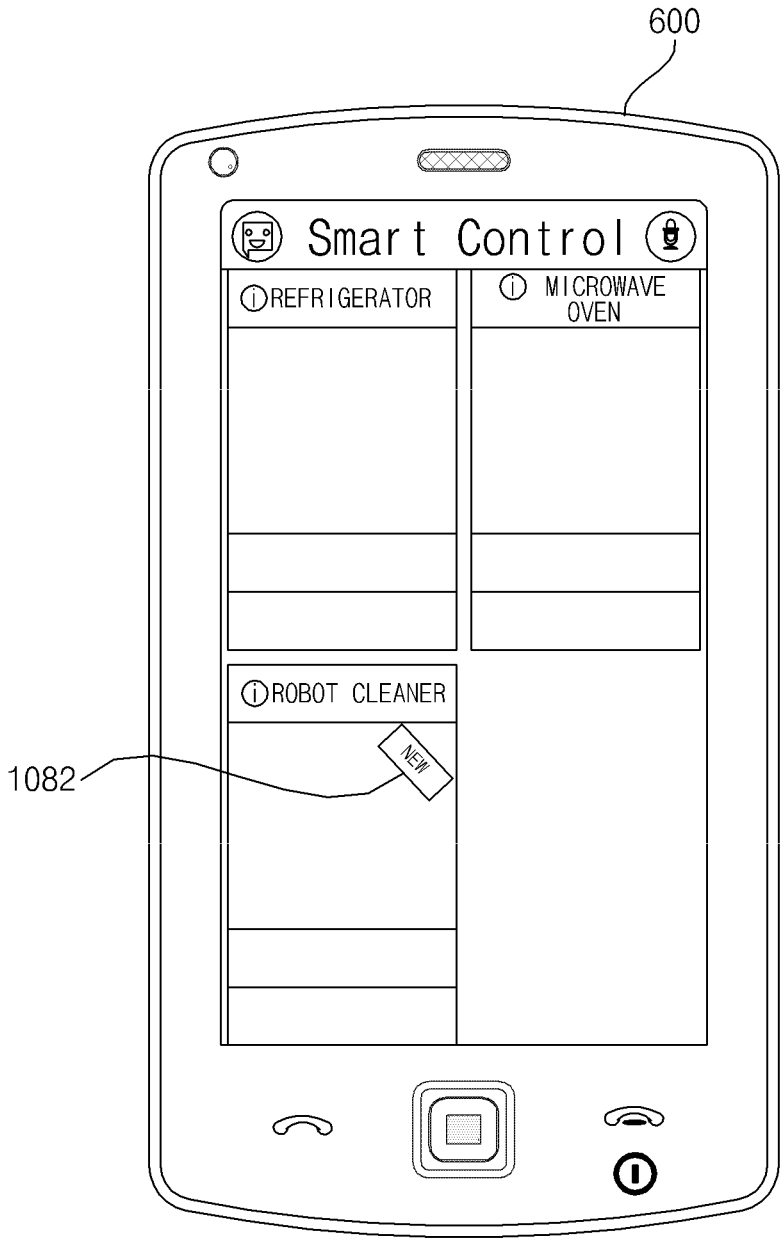

As shown in FIG. 11J, the product registration completion message 1080 may disappear after the lapse of a predetermined time and the icon 1082 indicating new product registration may be displayed in the object 1026 indicating the robot cleaner 200*e*.

The mobile terminal and the operation method thereof according to the present invention are not limitedly applicable to the constructions and methods of the embodiments as described above. For example, all or some of the embodiments may be selectively combined to achieve various modifications.

Meanwhile, the operation method of the mobile terminal or an operation method of a communication device may be realized as code, which is readable by a processor included in the home appliance, in recording media readable by the processor. The recording media readable by the processor include all kinds of recording devices to store data which are readable by the processor. Examples of the recording media readable by the processor may include a read only memory (ROM), a random access memory (RAM), a compact disc read only memory (CD-ROM), a magnetic tape, a floppy disk, and an optical data storage device. In addition, the recording media readable by the processor may also be realized in the form of a carrier wave, such as transmission through the Internet. Furthermore, the recording media readable by the processor may be distributed to computer systems connected to each other through a network such that code readable by the processor is stored or executed in a distributed manner.

As is apparent from the above description, according to an embodiment of the present invention, a mobile terminal may display an object indicating a retrieved unregistered home appliance on a screen and, upon receiving an input to register the unregistered home appliance, transmit product information of the unregistered home appliance to a server. Consequently, it is possible to easily and conveniently perform product registration for the unregistered home appliance.

In particular, the mobile terminal may display objects indicating home appliances having access to the same access point device and transmit product information of an unregistered one of the home appliances. Consequently, it is possible to easily and conveniently perform product registration for the unregistered home appliance.

Meanwhile, the mobile terminal may display a guide for network access of a home appliance having no access to the network. Consequently, it is possible for a user to easily and conveniently perform network setup.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An operation method of a mobile terminal including the touch screen, the method comprising:

executing and displaying a home appliance integration application to control a plurality of home appliances in a response to user input, wherein the home appliance integration application comprises a plurality of objects indicating the plurality of home appliances;

receiving information related to the plurality of home appliances, wherein the information related to the plurality of home appliances comprises product information of the plurality of home appliances or information regarding product registration and unregistration;

determining by a controller a home appliance not registered with a server based on the product information or the information regarding product registration and unregistration;

displaying by a display unit at least one an object indicating the retrieved unregistered home appliance on the touch screen;

displaying a first message informing that unregistered device is present, wherein the first message is overlapped with the object indicating the retrieved unregistered home appliance;

upon receiving a first touch input through an input unit by the controller to register the unregistered home appliance in a state where the object indicating the retrieved unregistered home appliance and another object indicating another retrieved unregistered home appliance are displayed on the touch screen, the another retrieved unregistered home appliance is in the same home appliance group as the retrieved unregistered home appliance, displaying a second message informing that the retrieved unregistered home appliance and the another retrieved unregistered home appliance belong to the same home appliance group and have access to a same access point device, and informing as to whether registration of the unregistered home appliance will progress, wherein the second message is overlapped with the plurality of objects indicating the plurality of home appliances;

upon receiving a second touch input of a progress item within the second message, transmitting through a communication unit product information of the unregistered home appliance to the server;

upon completion of registration with the server, displaying an icon indicating new product registration within the object.

2. The operation method according to claim 1, further comprising displaying by the display unit a message indicating completion of registration with the server on the screen.

3. The operation method according to claim 1, wherein the objects are arranged and displayed in an order registered with the server.

4. The operation method according to claim 1, further comprising displaying by the display unit a message to guide registration of the retrieved unregistered home appliance.

5. The operation method according to claim 1, further comprising, upon completion of registration with the server, displaying by the display unit a message to guide confirmation of correct registration.

6. The operation method according to claim 1, wherein the plurality of objects indicating the plurality of home appliances having access to the same access point device are displayed by the display unit on the screen.

7. The operation method according to claim 1, further comprising, upon receiving the first touch input by the controller to register the unregistered home appliance, receiving by the controller product information of the unregistered home appliance having access to the same access point device as the mobile terminal.

8. The operation method according to claim 1, further comprising:

upon entering a network access mode by the controller, displaying by the display unit a guide to perform network access for a predetermined home appliance on the screen; and upon completion of the network access for the corresponding home appliance, displaying by the display a message indicating the completion of the network access for the corresponding home appliance on the screen.

9. The operation method according to claim 8, wherein the network access guide comprises a Wi-Fi protected setup (WPS) type network access guide.

10. A mobile terminal comprising:

a communication unit to exchange data with home appliances; a touch screen including a display unit; and a controller to execute and display a home appliance integration application to control a plurality of home appliances in a response to user input, wherein the home appliance integration application comprises a plurality of objects indicating the plurality of home appliances, receive, through the communication unit, information related to the plurality of home appliances, wherein the information related to the plurality of home appliances comprises product information of the plurality of home appliances or information regarding product registration and unregistration, determine a home appliance not registered with a server based on the product information or the information regarding product registration and unregistration;

display at least one object indicating a home appliance not registered with a server among the home appliances on the touch screen, display a first message informing that unregistered device is present, wherein the first message is overlapped with the object indicating the retrieved unregistered home appliance;

upon receiving a first input to register the unregistered home appliance in a state where the object indicating the retrieved unregistered home appliance and another object indicating another retrieved unregistered home appliance are displayed on the touch screen, the another retrieved unregistered home appliance is in the same home appliance group as the retrieved unregistered home appliance, display a second message informing that the retrieved unregistered home appliance and the another retrieved unregistered home appliance belong to the same home appliance group and have access to a same access point device, and informing as to whether registration of the unregistered home appliance will progress, wherein the second message is overlapped with the plurality of objects indicating the plurality of home appliances;

upon receiving a second touch input of a progress item within the second message, control product information of the unregistered home appliance to be transmitted to the server, upon completion of registration with the server, display an icon indicating new product registration within the object.

11. The mobile terminal according to claim 10, wherein the controller causes the display unit to display a message indicating completion of product registration to the server when the product registration is completed.

12. The mobile terminal according to claim 10, wherein the controller arranges and causes the display unit to display objects indicating the home appliances in an order registered with the server.

13. The mobile terminal according to claim 10, wherein the controller causes the display unit to display a message to guide registration of the retrieved unregistered home appliance.

14. The mobile terminal according to claim 10, wherein, upon completion of registration with the server, the controller causes the display unit to display a message to guide confirmation of correct registration.

15. The mobile terminal according to claim 10, wherein the controller causes the display unit to display the plurality of objects indicating the plurality of home appliances having access to the same access point device among the home appliances on the screen.

16. The mobile terminal according to claim 10, wherein upon receiving the first touch input to register the unregistered home appliance, the controller causes the communication unit to receive product information of the unregistered home appliance having access to the same access point device as the mobile terminal.

17. The mobile terminal according to claim 10, wherein upon entering a network access mode, the controller causes the display unit to display a guide to perform network access for a predetermined home appliance, and upon completion of the network access for the corresponding home appliance, the controller causes the display unit to display a message indicating the completion of the network access for the corresponding home appliance.

18. The mobile terminal according to claim 17, wherein the network access guide comprises a WPS type network access guide.

* * * * *